US009851646B2

(12) United States Patent
Tomono et al.

(10) Patent No.: US 9,851,646 B2
(45) Date of Patent: Dec. 26, 2017

(54) ELECTROPHOTOGRAPHIC APPARATUS AND PROCESS CARTRIDGE

(71) Applicant: CANON KABUSHIKI KAISHA, Tokyo (JP)

(72) Inventors: Hiroyuki Tomono, Numazu (JP); Daisuke Miura, Tokyo (JP); Takashi Anezaki, Hiratsuka (JP); Yota Ito, Mishima (JP); Harunobu Ogaki, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/427,102

(22) Filed: Feb. 8, 2017

(65) Prior Publication Data

US 2017/0227858 A1 Aug. 10, 2017

(30) Foreign Application Priority Data

Feb. 10, 2016 (JP) ..... 2016-023765

(51) Int. Cl.

*G03G 5/04* (2006.01)
*G03G 21/18* (2006.01)
*G03G 15/02* (2006.01)

(52) U.S. Cl.

CPC ..... *G03G 5/04* (2013.01); *G03G 21/18* (2013.01); *G03G 15/0233* (2013.01)

(58) Field of Classification Search

CPC ..... G03G 5/04; G03G 21/18; G03G 15/0233; G03G 15/02

USPC ..... 399/168, 170, 174

See application file for complete search history.

(56) References Cited

U.S. PATENT DOCUMENTS

| | | | |
|---|---|---|---|
| 6,991,881 | B2 | 1/2006 | Ogaki et al. |
| 6,994,941 | B2 | 2/2006 | Tanaka et al. |
| 7,001,699 | B2 | 2/2006 | Tanaka et al. |
| 7,045,261 | B2 | 5/2006 | Tanaka et al. |
| 7,413,840 | B1 | 8/2008 | Ogaki et al. |
| 7,551,878 | B2 | 6/2009 | Ogaki et al. |
| 7,556,901 | B2 | 7/2009 | Anezaki et al. |
| 7,622,238 | B2 | 11/2009 | Uematsu et al. |
| 7,629,102 | B2 | 12/2009 | Ochi et al. |
| 7,645,547 | B2 | 1/2010 | Okuda et al. |
| 7,655,370 | B2 | 2/2010 | Kitamura et al. |
| 7,704,657 | B2 | 4/2010 | Uesugi et al. |
| 7,718,331 | B2 | 5/2010 | Uematsu et al. |
| 7,749,667 | B2 | 7/2010 | Kawahara et al. |
| 7,838,190 | B2 | 11/2010 | Ogaki et al. |
| 7,875,410 | B2 | 1/2011 | Ogaki et al. |

(Continued)

FOREIGN PATENT DOCUMENTS

| | | |
|---|---|---|
| JP | H01-277269 | 11/1989 |
| JP | 2005-114755 | 4/2005 |

(Continued)

*Primary Examiner* — Sandra Brase

(74) *Attorney, Agent, or Firm* — Fitzpatrick Cella Harper and Scinto

(57) ABSTRACT

Provided is an electrophotographic apparatus, including an electrophotographic photosensitive member, a charging unit arranged in a non-abutment manner with respect to the electrophotographic photosensitive member, a cleaning unit or a developing unit arranged in abutment against the electrophotographic photosensitive member, and a transferring unit.

14 Claims, 4 Drawing Sheets

(56) References Cited

U.S. PATENT DOCUMENTS

| | | | |
|---|---|---|---|
| 7,927,774 | B2 | 4/2011 | Ogaki et al. |
| 7,931,848 | B2 | 4/2011 | Ochi et al. |
| 8,457,528 | B2 | 6/2013 | Ochi et al. |
| 8,669,027 | B2 | 3/2014 | Anezaki et al. |
| 8,753,789 | B2 | 6/2014 | Ogaki et al. |
| 8,815,479 | B2 | 8/2014 | Shida et al. |
| 8,865,380 | B2 | 10/2014 | Noguchi et al. |
| 8,921,020 | B2 | 12/2014 | Murai et al. |
| 8,980,508 | B2 | 3/2015 | Okuda et al. |
| 8,980,509 | B2 | 3/2015 | Noguchi et al. |
| 8,980,510 | B2 | 3/2015 | Fujii et al. |
| 9,029,054 | B2 | 5/2015 | Okuda et al. |
| 9,034,545 | B2 | 5/2015 | Maruyama et al. |
| 9,063,505 | B2 | 6/2015 | Sekiya et al. |
| 9,069,267 | B2 | 6/2015 | Kaku et al. |
| 9,114,565 | B2 | 8/2015 | Kawai et al. |
| 9,164,406 | B2 | 10/2015 | Nishi et al. |
| 9,188,888 | B2 | 11/2015 | Okuda et al. |
| 9,207,550 | B2 | 12/2015 | Okuda et al. |
| 9,235,144 | B2 | 1/2016 | Yamamoto et al. |
| 9,274,442 | B2 | 3/2016 | Sato et al. |
| 9,280,071 | B2 | 3/2016 | Maruyama et al. |
| 9,280,072 | B2 | 3/2016 | Ogaki et al. |
| 9,282,615 | B2 | 3/2016 | Yamagishi et al. |
| 9,304,414 | B2 | 4/2016 | Miura et al. |
| 9,304,416 | B2 | 4/2016 | Noguchi et al. |
| 9,341,964 | B2 | 5/2016 | Ogaki et al. |
| 9,372,418 | B2 | 6/2016 | Shida et al. |
| 9,372,419 | B2 | 6/2016 | Tsuji et al. |
| 9,436,107 | B2 | 9/2016 | Murakami et al. |
| 9,507,283 | B2 | 11/2016 | Maruyama et al. |
| 9,523,929 | B2 | 12/2016 | Nakamura et al. |
| 9,535,346 | B2 | 1/2017 | Sekiya et al. |
| 9,575,422 | B2 | 2/2017 | Okuda et al. |
| 9,599,915 | B2 | 3/2017 | Anezaki et al. |
| 2001/0053298 | A1* | 12/2001 | Fujishiro ..... G03G 15/0208 399/159 |
| 2002/0001489 | A1* | 1/2002 | Ozaki ..... G03G 15/167 399/298 |
| 2006/0062594 | A1* | 3/2006 | Kawasumi ..... G03G 15/025 399/159 |
| 2010/0124436 | A1* | 5/2010 | Kinokuni ..... G03G 15/0233 399/168 |
| 2014/0154618 | A1 | 6/2014 | Maruyama et al. |
| 2014/0212800 | A1 | 7/2014 | Miura et al. |
| 2014/0356030 | A1* | 12/2014 | Fukuda ..... G03G 15/09 399/267 |
| 2015/0185630 | A1 | 7/2015 | Ito et al. |
| 2015/0185634 | A1 | 7/2015 | Sekiya et al. |
| 2016/0238957 | A1 | 8/2016 | Maruyama et al. |
| 2016/0327876 | A1 | 11/2016 | Miyauchi et al. |
| 2016/0378002 | A1 | 12/2016 | Tanaka et al. |

FOREIGN PATENT DOCUMENTS

| | | |
|---|---|---|
| JP | 2005-172863 | 6/2005 |
| JP | 2005-300741 | 10/2005 |
| JP | 2007-025725 | 2/2007 |

* cited by examiner

ELECTROPHOTOGRAPHIC APPARATUS AND PROCESS CARTRIDGE

BACKGROUND OF THE INVENTION

Field of the Invention

The present invention relates to an electrophotographic apparatus and a process cartridge.

Description of the Related Art

As an electrophotographic photosensitive member to be mounted to an electrophotographic apparatus, there is known an electrophotographic photosensitive member containing an organic photoconductive material (organic electrophotographic photosensitive member). In an electrophotographic process, units such as a charging unit, an exposing unit, a cleaning unit, and a charge eliminating unit act on the electrophotographic photosensitive member.

The charging unit may employ methods such as charging using discharge, frictional charging, and injection charging, and the charging method using discharge is widely employed because of its excellence in charging uniformity. The charging method using discharge includes an abutment charging method in which a charging member is brought into abutment against an electrophotographic photosensitive member, and a non-abutment charging method in which a gap is secured between the charging member and the electrophotographic photosensitive member.

In the non-abutment charging method, the wear amounts of the charging member and the electrophotographic photosensitive member can be reduced, and adverse effects including toner contamination to the charging member can be reduced. For example, in Japanese Patent Application Laid-Open No. 2007-25725, there is disclosed a technology of securing a gap between the electrophotographic photosensitive member and the charging member.

Further, in the abutment charging method, the electrophotographic photosensitive member tends to be significantly affected by the discharge that occurs in the vicinity of the surface of the electrophotographic photosensitive member brought into abutment against the charging member to cause wear of the surface. In Japanese Patent Application Laid-Open No. 2005-300741, there is described a technology of setting an interval between an end position of the charging unit and an end position of a developing unit within 8 mm, to thereby suppress local wear of the surface of the electrophotographic photosensitive member.

Further, in Japanese Patent Application Laid-Open No. H01-277269, there is described an electrophotographic apparatus having an effective transferring width that is smaller than an effective charging width, to thereby suppress toner adhesion contamination of the transferring unit.

Further, in Japanese Patent Application Laid-Open No. 2005-172863, the following technology is described. A surface layer of the electrophotographic photosensitive member contains a compound cured through polymerization, and a contact charging member and a cleaning member are brought into abutment against the electrophotographic photosensitive member within an area where the surface layer is present. With this, local wear of the surface of the electrophotographic photosensitive member against which the end of the contact charging member is brought into abutment can be suppressed.

Further, in Japanese Patent Application Laid-Open No. 2005-114755, there is disclosed a technology of defining an opening width of a grid electrode (width of an area to be charged), a width of the electrophotographic photosensitive member, a width of a developing area, a width of a transferring area, and a width of a sheet powder removing area.

SUMMARY OF THE INVENTION

According to one embodiment of the present invention, there is provided an electrophotographic apparatus, including:

an electrophotographic photosensitive member having a cylindrical shape;

a charging unit, which is arranged in a non-abutment manner with respect to the electrophotographic photosensitive member, and is configured to charge the electrophotographic photosensitive member;

a cleaning unit, which is arranged in abutment against the electrophotographic photosensitive member, and is configured to clean a surface of the electrophotographic photosensitive member; and a transferring unit configured to transfer a toner image onto a transfer material, the electrophotographic photosensitive member including a charge generating layer and a surface layer in this order, the electrophotographic photosensitive member satisfying Expression (1), Expression (2), and Expression (3):

$$L1<L5<L3 \quad (1);$$

$$L1>L2 \quad (2); \text{ and}$$

$$L1>L4 \quad (3),$$

where L1 represents a width (mm) from a center of an image forming area in a longitudinal direction of the electrophotographic photosensitive member to an end of a charging area, L2 represents a width (mm) from the center of the image forming area in the longitudinal direction of the electrophotographic photosensitive member to an end of a transferring area, L3 represents a width (mm) from the center of the image forming area in the longitudinal direction of the electrophotographic photosensitive member to an end of a surface layer formed area in which the surface layer is formed, L4 represents a width (mm) from the center of the image forming area in the longitudinal direction of the electrophotographic photosensitive member to an end of a charge generating layer formed area in which the charge generating layer is formed, and L5 represents a width (mm) from the center of the image forming area in the longitudinal direction of the electrophotographic photosensitive member to an end of a cleaning area.

Further, according to one embodiment of the present invention, there is provided an electrophotographic apparatus, including:

an electrophotographic photosensitive member having a cylindrical shape;

a charging unit, which is arranged in a non-abutment manner with respect to the electrophotographic photosensitive member, and is configured to charge the electrophotographic photosensitive member;

a developing unit, which is arranged in abutment against the electrophotographic photosensitive member, and is configured to develop a toner image on the electrophotographic photosensitive member; and a transferring unit configured to transfer the toner image onto a transfer material, the electrophotographic photosensitive member including a charge generating layer and a surface layer in this order, the electrophotographic photosensitive member satisfying Expression (1), Expression (2), and Expression (3):

$$L1<L5<L3 \quad (1);$$

$$L1>L2 \quad (2); \text{ and}$$

$$L1>L4 \quad (3),$$

where L1 represents a width (mm) from a center of an image forming area in a longitudinal direction of the electrophotographic photosensitive member to an end of a charging area, L2 represents a width (mm) from the center of the image forming area in the longitudinal direction of the electrophotographic photosensitive member to an end of a transferring area, L3 represents a width (mm) from the center of the image forming area in the longitudinal direction of the electrophotographic photosensitive member to an end of a surface layer formed area in which the surface layer is formed, L4 represents a width (mm) from the center of the image forming area in the longitudinal direction of the electrophotographic photosensitive member to an end of a charge generating layer formed area in which the charge generating layer is formed, and L5 represents a width (mm) from the center of the image forming area in the longitudinal direction of the electrophotographic photosensitive member to an end of a developing area.

Still further, according to one embodiment of the present invention, there is provided a process cartridge, which is configured to be removably mounted to a main body of an electrophotographic apparatus, the process cartridge including:

an electrophotographic photosensitive member having a cylindrical shape;

a charging unit, which is arranged in a non-abutment manner with respect to the electrophotographic photosensitive member, and is configured to charge the electrophotographic photosensitive member; and a cleaning unit, which is arranged in abutment against the electrophotographic photosensitive member, and is configured to clean a surface of the electrophotographic photosensitive member, the electrophotographic photosensitive member including a charge generating layer and a surface layer in this order, and having a transferring area to be opposed to a transferring unit configured to transfer a toner image onto a transfer material, the electrophotographic photosensitive member satisfying Expression (1), Expression (2), and Expression (3):

$$L1<L5<L3 \quad (1);$$

$$L1>L2 \quad (2); \text{ and}$$

$$L1>L4 \quad (3),$$

where L1 represents a width from a center of an image forming area in a longitudinal direction of the electrophotographic photosensitive member to an end of a charging area, L2 represents a width from the center of the image forming area in the longitudinal direction of the electrophotographic photosensitive member to an end of the transferring area, L3 represents a width from the center of the image forming area in the longitudinal direction of the electrophotographic photosensitive member to an end of a surface layer formed area in which the surface layer is formed, L4 represents a width from the center of the image forming area in the longitudinal direction of the electrophotographic photosensitive member to an end of a charge generating layer formed area in which the charge generating layer is formed, and L5 represents a width from the center of the image forming area in the longitudinal direction of the electrophotographic photosensitive member to an end of a cleaning area.

Yet further, according to one embodiment of the present invention, there is provided a process cartridge, which is configured to be removably mounted to a main body of an electrophotographic apparatus, the process cartridge including:

an electrophotographic photosensitive member having a cylindrical shape;

a charging unit, which is arranged in a non-abutment manner with respect to the electrophotographic photosensitive member, and is configured to charge the electrophotographic photosensitive member; and a developing unit, which is arranged in abutment against the electrophotographic photosensitive member, and is configured to develop a toner image on the electrophotographic photosensitive member, the electrophotographic photosensitive member including a charge generating layer and a surface layer in this order, and having a transferring area to be opposed to a transferring unit configured to transfer the toner image onto a transfer material, the electrophotographic photosensitive member satisfying relationships represented by Expression (1), Expression (2), and Expression (3):

$$L1<L5<L3 \quad (1);$$

$$L1>L2 \quad (2); \text{ and}$$

$$L1>L4 \quad (3),$$

where L1 represents a width from a center of an image forming area in a longitudinal direction of the electrophotographic photosensitive member to an end of a charging area, L2 represents a width from the center of the image forming area in the longitudinal direction of the electrophotographic photosensitive member to an end of the transferring area, L3 represents a width from the center of the image forming area in the longitudinal direction of the electrophotographic photosensitive member to an end of a surface layer formed area in which the surface layer is formed, L4 represents a width from the center of the image forming area in the longitudinal direction of the electrophotographic photosensitive member to an end of a charge generating layer formed area in which the charge generating layer is formed, and L5 represents a width from the center of the image forming area in the longitudinal direction of the electrophotographic photosensitive member to an end of a developing area.

Further features of the present invention will become apparent from the following description of exemplary embodiments with reference to the attached drawings.

DESCRIPTION OF THE EMBODIMENTS

Figure 1:
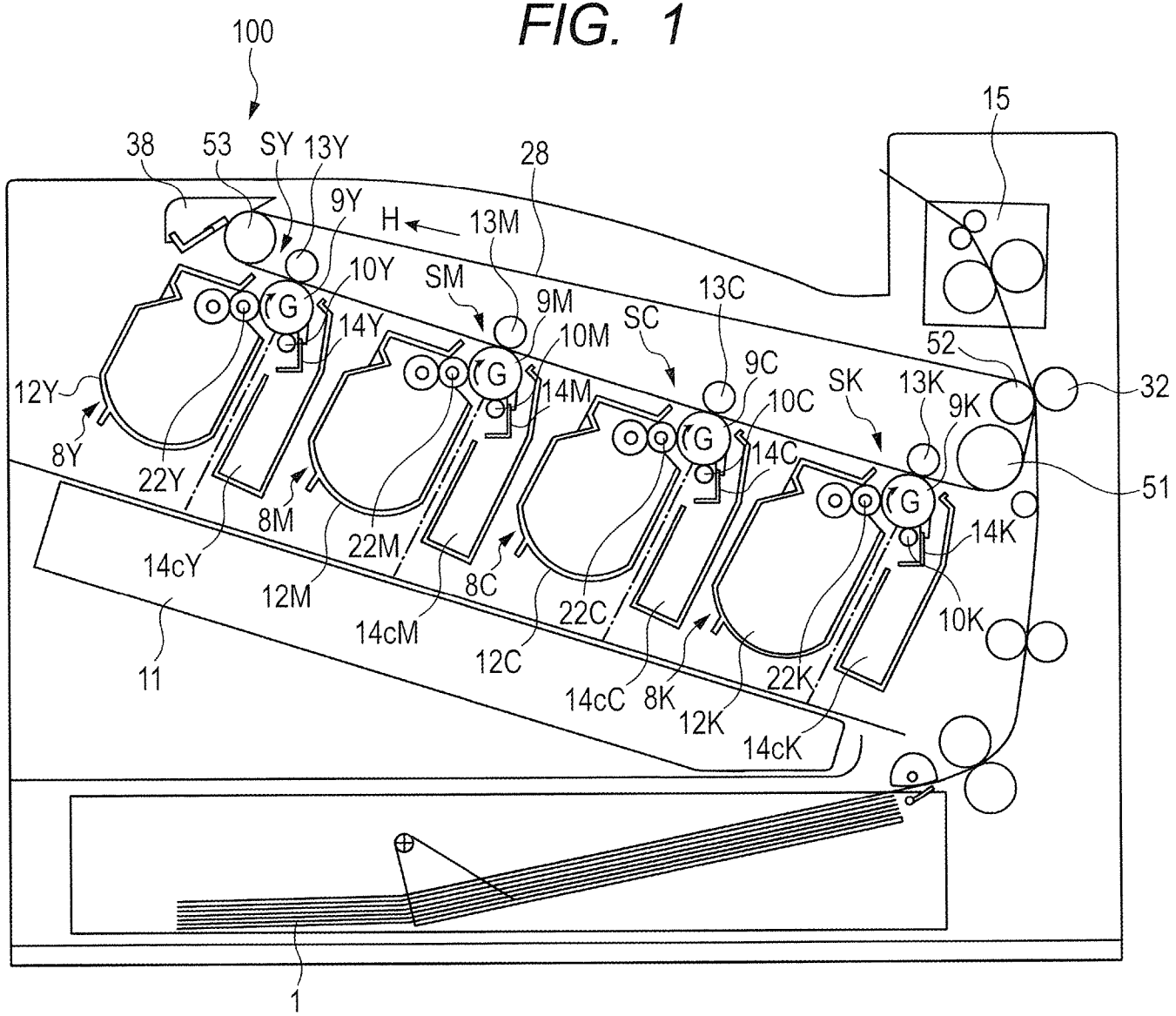
FIG. 1 is a schematic sectional view of an electrophotographic apparatus according to an embodiment of the present invention.

Preferred embodiments of the present invention will now be described in detail in accordance with the accompanying drawings.

In recent years, there have been demands for an electrophotographic apparatus to have an increased rotational speed of an electrophotographic photosensitive member due to increased printing speed, and to effectively remove spherical or small-diameter toner used for increasing image quality. Further, due to the extended life of the electrophotographic apparatus, when the electrophotographic apparatus is used for a long period, sheet powder or toner may adhere to a charging member or other members to cause an image defect due to abnormal discharge. In view of this, an abutment charging method may be changed to a non-abutment charging method so that the charging member and the electrophotographic photosensitive member can be reduced in wear amounts and adhesion of foreign matters. However, the inventors of the present invention have conducted studies and found as a result that the non-abutment charging method causes an increase in frictional load of other abutment members with respect to the electrophotographic photosensitive member, and it is necessary to further reduce local wear of the surface of the electrophotographic photosensitive member at an end of an abutment area between the electrophotographic photosensitive member and the abutment member. Specifically, the following reason is conceivable. The electrophotographic photosensitive member has a larger discharge current at an end of a charging area than at a center of the charging area, and has a specifically high current density only in this part. Due to this, the surface of the electrophotographic photosensitive member is chemically deteriorated, and the surface of the electrophotographic photosensitive member is easily worn through sliding contact with other abutment members even when the charging unit is arranged in a non-abutment manner. Further, the local wear of the surface of the electrophotographic photosensitive member may induce leakage of a charging bias to cause an image defect.

The present invention has an object to provide an electrophotographic apparatus and a process cartridge that are capable of reducing local wear of the surface of the electrophotographic photosensitive member, to thereby suppress an image defect to be caused by the surface wear.

According to the present invention, the electrophotographic apparatus includes a cylindrical electrophotographic photosensitive member, a charging unit, a cleaning unit or a developing unit, and a transferring unit. Further, according to the present invention, the process cartridge is configured to be removably mounted to a main body of the electrophotographic apparatus, and includes a cylindrical electrophotographic photosensitive member, a charging unit, and a cleaning unit or a developing unit. The electrophotographic photosensitive member includes a charge generating layer, and a surface layer formed on the charge generating layer. Further, the electrophotographic photosensitive member has a transferring area to be opposed to the transferring unit.

According to the present invention, the charging unit refers to a unit configured to charge the surface of the electrophotographic photosensitive member, and a charged area (or an area to be charged) of the surface of the electrophotographic photosensitive member is referred to as a charging area. Further, according to the present invention, the cleaning unit refers to a unit configured to remove toner (transfer residual toner) remaining on the electrophotographic photosensitive member after transfer, and an area in which the transfer residual toner is to be removed by the cleaning unit is referred to as a cleaning area. Further, according to the present invention, the developing unit refers to a unit configured to develop an electrostatic latent image as a toner image, and an area in which the electrostatic latent image is to be developed as a toner image on the electrophotographic photosensitive member is referred to as a developing area. Still further, according to the present invention, the transferring unit refers to a unit configured to transfer the toner image formed on the electrophotographic photosensitive member, and an area in which the toner image can be transferred is referred to as a transferring area.

Figure 3:
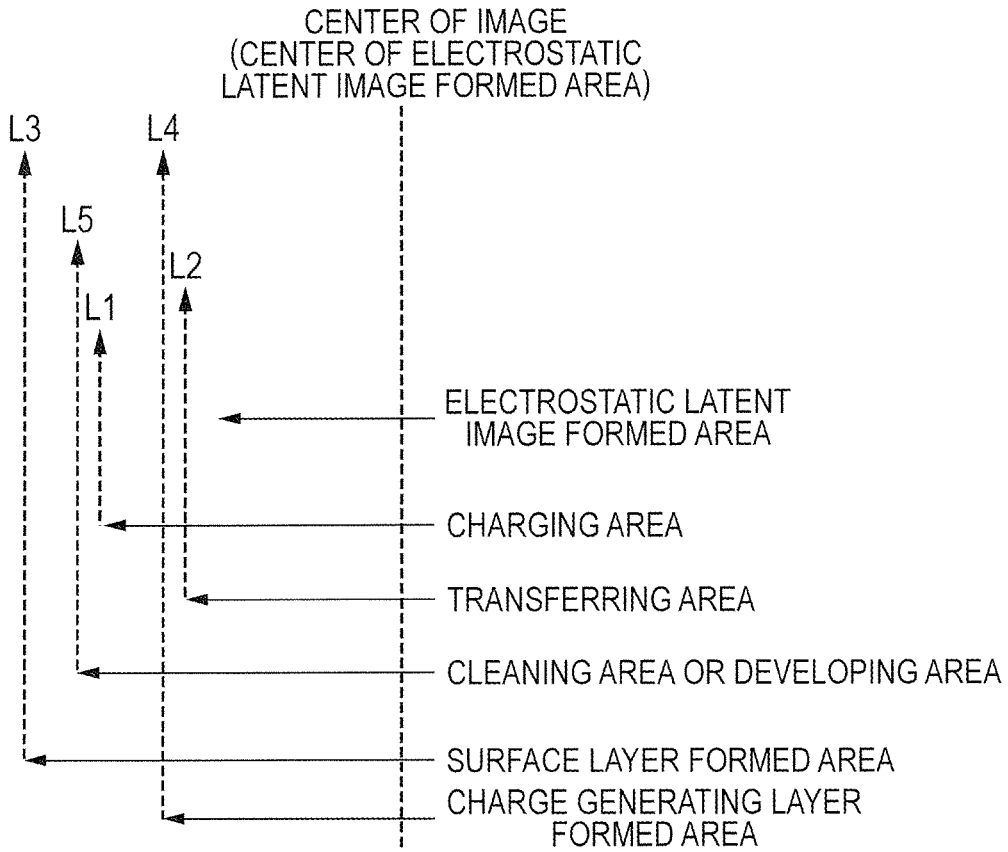
FIG. 3 is a diagram for illustrating a relationship in longitudinal direction between the electrophotographic apparatus and an electrophotographic photosensitive member according to the embodiment of the present invention.
Figure 4:
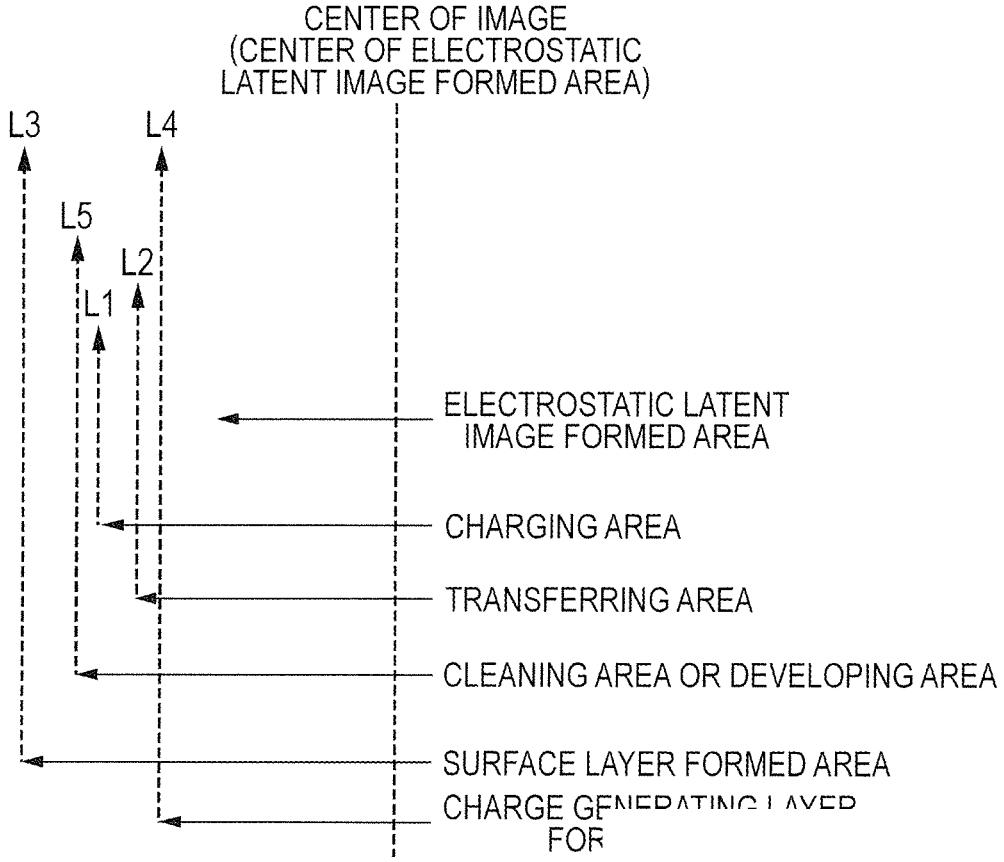
FIG. 4 is a diagram for illustrating a relationship in longitudinal direction between the electrophotographic apparatus and an electrophotographic photosensitive member according to the embodiment of the present invention.

Now, with reference to FIG. 3 and FIG. 4, as an example, a relationship in longitudinal length between the electrophotographic photosensitive member and the electrophotographic apparatus whose maximum sheet feeding width is a short-side width of an LTR sheet is described.

First, the width of the LTR sheet is about 216 mm. In the electrophotographic apparatus, an electrostatic latent image is formed over the entire width of the LTR sheet, and hence a laser beam radiation width of a scanner unit (exposure device) for image formation is larger than the LTR sheet width. That is, a relationship of "LTR sheet width"<"laser beam radiation width" is set. The radiation width (area) of exposure light for forming an image is referred to as an image forming area. An area of the electrophotographic photosensitive member in which image exposure light is prevented from being radiated by an exposing unit is referred to as a non-image forming area. When this image exposure width (image forming area) is larger than the LTR width, which is the maximum width that the electrophotographic apparatus can feed as described above, an image can be formed on the entire LTR sheet. A center position of the image exposure width is a center of an image (a center of the image forming area, that is, a center of an electrostatic latent image formed area in a longitudinal direction of the electrophotographic photosensitive member). In order to control image forming conditions, exposure light is sometimes radiated to the electrophotographic photosensitive member to form a developer image for image density control on the electrophotographic photosensitive member. However, this exposure light is not used for image formation, and hence does not relate to specifying of the image forming area of the present invention described above.

Further, the present invention has a feature of satisfying Expression (1), Expression (2), and Expression (3):

$$L1<L5<L3 \quad (1);$$

$$L1>L2 \quad (2); \text{ and}$$

$$L1>L4 \quad (3),$$

where L1 represents a width from the center of the image forming area in the longitudinal direction of the electrophotographic photosensitive member to the end of the charging area, L2 represents a width from the center of the image forming area in the longitudinal direction of the electrophotographic photosensitive member to an end of the transferring area, L3 represents a width from the center of the image forming area in the longitudinal direction of the electrophotographic photosensitive member to an end of a surface layer formed area in which the surface layer is formed, L4 represents a width from the center of the image forming area in the longitudinal direction of the electrophotographic photosensitive member to an end of a charge generating layer formed area in which the charge generating layer is formed, and L5 represents a width from the center of the image forming area in the longitudinal direction of the electrophotographic photosensitive member to an end of the cleaning area or a width from the center of the image forming area in the longitudinal direction of the electrophotographic photosensitive member to an end of the developing area.

In this case, each of L1 to L5 is present on two sides in the longitudinal direction of the electrophotographic photosensitive member. The two sides are specifically one end side and another end side in an electrophotographic apparatus 100. In the present invention, L1 to L5 are defined as widths on the same side from the center of the image forming area. In the present invention, when L1 to L5 on any one of the one end side and the another end side satisfy Expression (1) to Expression (3), the effect of the present invention can be obtained. In FIG. 3 and FIG. 4, only one side is illustrated for the sake of convenience. When L1 to L5 on both of the one end side and the another end side satisfy Expression (1) to Expression (3), the effect of the present invention is improved.

The inventors of the present invention consider the cause of the tendency of wear of the surface (surface layer) of the electrophotographic photosensitive member at the end of the charging area of the electrophotographic photosensitive member to be as follows.

In the non-abutment charging method, the charging unit uses a discharge phenomenon to charge the electrophotographic photosensitive member. At this time, the electrophotographic photosensitive member has a larger discharge current at the end of the charging area than at a center of the charging area, and has a specifically high current density at the end. Therefore, it is considered that the surface of the electrophotographic photosensitive member is deteriorated earlier at the end of the charging area, and that the surface of the electrophotographic photosensitive member at the end of the charging area may be easily worn when a large mechanical stress is received through sliding contact between the electrophotographic photosensitive member and other abutment members. In the surface of the photosensitive member opposed to the charging member, discharge also occurs at the edge part (end) of the charging unit in the circumferential direction of the photosensitive member, and hence the long discharge exposed time period of the surface of the photosensitive member per rotation of the photosensitive member is also considered as one cause. Further, as the wear of the surface of the electrophotographic photosensitive member at the end of the charging area progresses and becomes equal to or less than an insulation resistance, current from the charging unit to the surface of the electrophotographic photosensitive member concentrates at the end of the charging area, and hence an image defect more easily occurs. In other words, insulation resistance is reduced in the worn part of the surface of the electrophotographic photosensitive member at the end of the charging area. Therefore, for example, leakage of a charging bias may be induced to cause occurrence of a black lateral streak due to insufficiency in charging. Further, a larger amount of developer is attracted to the worn part of the surface of the electrophotographic photosensitive member at the end of the charging area, and hence contamination in the electrophotographic apparatus may be promoted. At this time, examples of the other abutment members include a developing member and a cleaning member.

The inventors of the present invention have conducted studies and found as a result that, when Expression (1) to Expression (3) are satisfied, the wear of the surface of the electrophotographic photosensitive member at the end of the charging area is reduced, and an image defect or contamination in the electrophotographic apparatus due to the wear is suppressed.

The configurations of the electrophotographic apparatus and the process cartridge of the present invention have such a feature that the cylindrical electrophotographic photosensitive member, the charging unit, the cleaning unit or the developing unit, and the transferring unit are arranged so as to satisfy Items (1) to (3). (1) The charging unit is arranged in a non-contact manner with respect to the electrophotographic photosensitive member, and the width (L1) from the center of the image forming area in the longitudinal direction of the electrophotographic photosensitive member to the end of the charging area is smaller than the width (L5) from the center of the image forming area in the longitudinal direction of the electrophotographic photosensitive member to the end of the cleaning area or the width (L5) from the center of the image forming area in the longitudinal direction of the electrophotographic photosensitive member to the end of the developing area. Further, L5 is smaller than the width (L3) from the center of the image forming area in the longitudinal direction of the electrophotographic photosensitive member to the end of the surface layer formed area in which the surface layer is formed. (2) The width (L4) from the center of the image forming area in the longitudinal direction of the electrophotographic photosensitive member to the end of the charge generating layer formed area in which the charge generating layer is formed is smaller than the width (L1) from the center of the image forming area in the longitudinal direction of the electrophotographic photosensitive member to the end of the charging area. (3) The width (L2) from the center of the image forming area in the longitudinal direction of the electrophotographic photosensitive member to the end of the transferring area is smaller than the width (L1) from the center of the image forming area in the longitudinal direction of the electrophotographic photosensitive member to the end of the charging area.

The inventors of the present invention estimate the reason why the effect of the present invention can be obtained with this feature as follows.

During an image forming operation of the electrophotographic apparatus, the electrophotographic photosensitive member is subjected to respective steps of charging, exposure, development, and transfer. During the charging step, a voltage is applied by a power supply device to charge the surface of the electrophotographic photosensitive member, and an electrostatic latent image is formed in the exposure step. At this time, in the charging step, the electrophotographic photosensitive member is charged such that its surface potential becomes Vd, and in the exposure step, the electrophotographic photosensitive member is exposed such that its surface potential becomes Vl. Next, in the transfer step, a transfer bias is applied to the electrophotographic photosensitive member, and the surface potential of the electrophotographic photosensitive member becomes Vt. In the next step, the electrophotographic photosensitive member is required to be charged such that its surface potential varies from Vt to Vd. In this manner, due to discharge with a large potential difference, deterioration in the surface of the electrophotographic photosensitive member easily occurs.

In the electrophotographic apparatus and the process cartridge of the present invention, the width in which the charge generating layer is formed in the electrophotographic photosensitive member is smaller than the width of the charging area that is formed by the charging unit on the electrophotographic photosensitive member. Therefore, the surface of the electrophotographic photosensitive member opposed to the end of the charging unit is an area in which the charge generating layer is not formed, and hence it is considered that the surface potential of the electrophotographic photosensitive member in this area does not become V1 in the exposure step. In addition, the width in which the transferring unit is opposed to the electrophotographic photosensitive member is smaller than the width in which the charging unit is opposed to the electrophotographic photosensitive member. Therefore, the surface of the electrophotographic photosensitive member opposed to the end of the charging unit is an area not opposed to the transferring unit, and hence it is considered that the surface potential of the electrophotographic photosensitive member in this area does not become Vt in the transfer step. Therefore, it is considered that the surface potential of the surface of the electrophotographic photosensitive member opposed to the end of the charging unit remains in the vicinity of Vd, and large discharge does not occur in the next charging step, with the result that the deterioration of the surface area of the electrophotographic photosensitive member opposed to the end of the charging unit may be suppressed. It is considered that, with the configuration of the present invention, the deterioration of the surface area of the electrophotographic photosensitive member, which is opposed to the end of the charging unit during the image forming operation of the electrophotographic apparatus, may be suppressed, and hence local wear can be suppressed even when the abutment members such as the cleaning unit and the developing unit are brought into sliding contact with the electrophotographic photosensitive member.

Further, a charge eliminating step may be provided between the transfer step and the charging step. This charge eliminating step is preferred to be carried out by the exposing unit. In this case, the surface potential of the electrophotographic photosensitive member at the end opposed to the charging unit remains in the vicinity of Vd, and hence is not reduced through charge elimination. Therefore, the influence of discharge is reduced, and the effect of the present invention becomes more remarkable.

Further, L1, L2, and L4 are preferred to satisfy a relationship represented by Expression (4) or Expression (5).

$$L1>L4>L2 \quad (4)$$

$$L1>L2>L4 \quad (5)$$

When the relationship of Expression (4) or Expression (5) is satisfied, the width in which the charge generating layer is formed is different from the width in which the transferring unit is opposed to the electrophotographic photosensitive member. This state is preferred because the influence of discharge from the end of the transferring unit can be reduced, and the wear of the surface of the electrophotographic photosensitive member can be more reduced.

It is further preferred that L1 be separated by 2 mm or more from the longer one of L2 and L4. Further, it is preferred that the difference between L2 and L4 be 1 mm or more.

Now, the present invention is described with reference to FIG. 1 and FIG. 2. The present invention is not limited to the dimensions, materials, shapes, and relative arrangement of the components described in this embodiment unless specifically noted.

(Entire Configuration of Electrophotographic Apparatus Example)

The entire configuration of the electrophotographic apparatus of the present invention is described. FIG. 1 is a schematic sectional view of an electrophotographic apparatus 100 according to an embodiment of the present invention.

The electrophotographic apparatus 100 includes, as a plurality of image forming portions, a first image forming portion SY, a second image forming portion SM, a third image forming portion SC, and a fourth image forming portion SK for respectively forming yellow (Y), magenta (M), cyan (C), and black (K) images. In FIG. 1, the first to fourth image forming portions S (SY, SM, SC, and SK) are arranged in line in a direction intersecting with a vertical direction.

In the electrophotographic apparatus of the present invention, the first to fourth image forming portions each have substantially the same structure and perform substantially the same operations except that the image forming portions form images in different colors. Thus, in the following, unless it is necessary to make specific distinctions, Y, M, C, and K are omitted so that the components are collectively described.

The electrophotographic apparatus 100 includes four electrophotographic photosensitive members 9 (9Y, 9M, 9C, and 9K) arranged side by side in the direction intersecting with the vertical direction. Each of the electrophotographic photosensitive members 9 is configured to rotate in an arrow G direction of FIG. 1. Charging rollers 10 (10Y, 10M, 10C, and 10K) and a scanner unit 11 are arranged around the electrophotographic photosensitive members 9.

In this case, each of the electrophotographic photosensitive members 9 is an image bearing member configured to bear a toner image. Each of the charging rollers 10 is a charging unit configured to uniformly charge the surface of the electrophotographic photosensitive member 9. Further, the scanner unit (exposure device) 11 is an exposing unit configured to radiate laser emitted based on image information to form an electrostatic latent image on the electrophotographic photosensitive member 9. Further, around the electrophotographic photosensitive members 9, developing units 12 (12Y, 12M, 12C, and 12K) and cleaning blades 14 (14Y, 14M, 14C, and 14K) are arranged.

In this case, each of the developing units 12 is a developing unit configured to develop the electrostatic latent image as a toner image. As the developing unit, an appropriate developing unit may be selected depending on the developing method to be employed. Examples of the developing method to be employed in the present invention include a one-component developing method that uses only toner for development, a two-component developing method that uses toner mixed with a carrier for development, an abutment developing method in which the photosensitive member is brought into abutment against toner, and a non-abutment developing method in which the photosensitive member is not brought into abutment against toner. Examples of a voltage to be applied to a developing roller 22 include a DC voltage alone, and a voltage obtained by superimposing an AC voltage on a DC voltage. Further, each of the cleaning blades 14 is a cleaning unit configured to remove toner (transfer residual toner) remaining on the surface of the electrophotographic photosensitive member 9 after transfer. Further, an intermediate transfer belt 28 serving as an intermediate transfer member configured to transfer the toner image formed on the electrophotographic photosensitive member 9 onto a transfer material 1 is arranged so as to be opposed to the four electrophotographic photosensitive members 9.

In the electrophotographic apparatus of the present invention, the electrophotographic photosensitive member 9, the charging roller 10, the developing unit 12, and the cleaning blade 14 are integrated into a cartridge to form each of process cartridges 8 (8Y, 8M, 8C, and 8K). Each of the process cartridges 8 is configured to be removably mounted to the electrophotographic apparatus 100 via a mounting unit (not shown), e.g., a mounting guide or a positioning member, which is formed on the main body of the electrophotographic apparatus 100.

In FIG. 1, the process cartridges 8 for the respective colors each have the same shape, and respectively contain yellow (Y), magenta (M), cyan (C), and black (K) toners. The intermediate transfer belt 28 is brought into abutment against the above-mentioned four electrophotographic photosensitive members 9, and is configured to rotate in an arrow H direction of FIG. 1.

The intermediate transfer belt 28 is looped around a plurality of support members (drive roller 51, secondary transfer opposing roller 52, and driven roller 53). On the inner peripheral surface side of the intermediate transfer belt 28, four primary transfer rollers 13 (13Y, 13M, 13C, and 13K) serving as primary transfer units are arranged side by side so as to be opposed to the respective electrophotographic photosensitive members 9. Further, on the outer peripheral surface side of the intermediate transfer belt 28, a secondary transfer roller 32 serving as a secondary transfer unit is arranged at a position opposed to the secondary transfer opposing roller 52.

At the time of image formation, the surface of the electrophotographic photosensitive member 9 is uniformly charged by the charging roller 10. Then, the surface of the electrophotographic photosensitive member 9 thus charged is subjected to scanning exposure with the laser beam emitted based on the image information issued from the scanner unit 11 so as to form an electrostatic latent image based on the image information on the electrophotographic photosensitive member 9. Next, the electrostatic latent image formed on the electrophotographic photosensitive member 9 is developed into a toner image by the developing unit 12. The toner image held on the electrophotographic photosensitive member 9 is transferred (primarily transferred) onto the intermediate transfer belt 28 with the primary transfer roller 13. In the present invention, the width of the primary transfer roller 13 is set to a length to be described later.

During formation of a full-color image, the above-mentioned process is sequentially performed in each of the first to fourth image forming portions SY, SM, SC, and SK, and thus toner images of respective colors are sequentially primarily transferred onto the intermediate transfer belt 28 in a superimposed manner. After that, the transfer material 1 is conveyed to a secondary transfer portion in synchronization with the movement of the intermediate transfer belt 28. Then, due to the action of the secondary transfer roller 32 that is in abutment against the intermediate transfer belt 28 across the transfer material 1, the four-color toner images formed on the intermediate transfer belt 28 are collectively secondarily transferred onto the transfer material 1.

The transfer material 1 having the toner images transferred thereon is conveyed to a fixing device 15 serving as a fixing unit. In the fixing device 15, the transfer material 1 is heated and pressurized to fix the toner images onto the transfer material 1. Further, primary transfer residual toner remaining on the electrophotographic photosensitive members 9 after the primary transfer step is removed by the cleaning blades 14 to be collected in removal toner chambers 14*c* (14*c*Y, 14*c*M, 14*c*C, and 14*c*K). Further, secondary transfer residual toner remaining on the intermediate transfer belt 28 after the secondary transfer step is removed by an intermediate transfer belt cleaning device 38.

The electrophotographic apparatus 100 is also capable of forming a single-color or multi-color image with use of only a desired single or several (not all) image forming portions.

As the intermediate transfer belt 28, it is preferred to use an intermediate transfer belt formed of a semi-electroconductive resin belt having a volume resistivity of from $1\times10^4$ $\Omega\cdot cm^2$ to $1\times10^{12}$ $\Omega\cdot cm^2$. Specifically, there may be used, for example, a belt obtained by dispersing an electroconductive filler, such as carbon, or incorporating an ionic electroconductive material, into a resin, such as polycarbonate, polyimide, polyamide-imide, polyvinylidene fluoride, or a tetrafluoroethylene-ethylene copolymer, or a rubber, such as an ethylene-propylene rubber, an acrylonitrile-butadiene rubber, a chloroprene rubber, or a polyurethane rubber.

The primary transfer roller 13 includes a cored bar made of a metal that also serves as a feeding electrode to which a transfer bias is applied, and an elastic member arranged on the outer peripheral surface of the cored bar. For example, a rubber, such as a urethane rubber, a silicone rubber, an ethylene-propylene rubber (EPM), an ethylene-propylene-diene terpolymer rubber (EPDM), or an isoprene rubber (IR), may be used as a material for the elastic member. An electroconductive material to be dispersed in the rubber is, for example, carbon, zinc oxide, or tin oxide. Then, the rubber having dispersed therein the electroconductive material is formed into a desired wall thickness on the cored bar made of the metal, such as SUS or aluminum, by foaming or in-mold formation. Further, the rubber is shaped into a desired shape by polishing or the like as required.

In the present invention, the charging unit employing the non-abutment charging method is used. In FIG. 1 and FIG. 2, the charging roller 10 is illustrated in abutment against the electrophotographic photosensitive member, but the charging roller 10 and the electrophotographic photosensitive member are arranged with an appropriate gap of from about 10 μm to about 200 μm secured therebetween. The charging member to be used in the present invention may have any form as long as the charging member has a mechanism capable of appropriately controlling a gap between the surface of the charging member and the surface of the electrophotographic photosensitive member. For example, the electrophotographic photosensitive member and the charging member may be arranged such that a rotary shaft of the electrophotographic photosensitive member and a rotary shaft of the charging member are mechanically fixed to secure an appropriate gap. It is preferred that a gap between the surface of the charging member and the surface of the electrophotographic photosensitive member, that is, the appropriate gap be 200 μm or less. In order to obtain the appropriate gap, for example, there is a method of arranging gap forming members at both ends of a non-image forming portion of the charging roller, and bringing only those parts into abutment against the surface of the electrophotographic photosensitive member, to thereby arrange the image forming area in a non-abutment manner.

Figure 5:
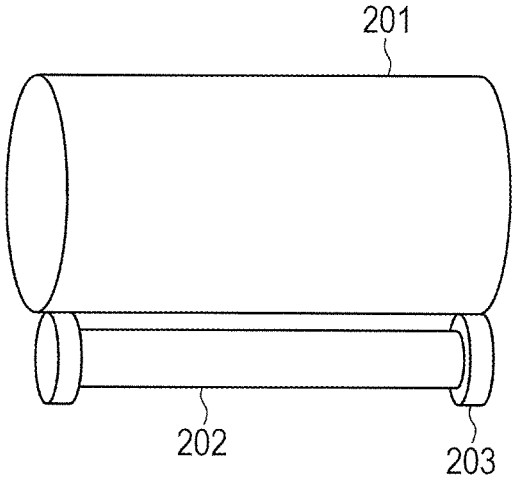
FIG. 5 is a schematic view for illustrating a non-abutment charging mechanism.

An example of a non-abutment charging mechanism of an electrophotographic photosensitive member 201 and a charging roller 202 in which gap forming members 203 are arranged on the charging member side being the charging roller 202 is illustrated in FIG. 5.

Although the charging roller has a structure in which an electroconductive elastic layer, a resistance control layer, and a surface layer are laminated around an electroconductive cored bar in this order in many cases, the charging roller only needs to include at least the cored bar and the elastic body. As a material for the elastic member, there are given, for example, resins and rubbers, such as urethane, a styrene-butadiene rubber (SBR), an ethylene-vinyl acetate copolymer (EVA), a styrene-butadiene-styrene block copolymer (SBS), a styrene-ethylene-butylene-styrene block copolymer (SEBS), a styrene-isoprene block copolymer (SIS), an olefin-based thermoplastic elastomer (TPO), an EPDM, an EPM, an acrylonitrile-butadiene rubber (NBR), an IR, a butadiene rubber (BR), a silicone rubber, and an epichlorohydrin rubber. For example, an electroconductivity-imparting material, such as carbon black, a carbon fiber, a metal oxide, a metal powder, a solid electrolyte, e.g., a perchlorate, or a surfactant, may be added to the elastic body for the purpose of controlling its resistance value of the material for the elastic member. A material for the resistance control layer is, for example, a resin or a rubber, such as polyamide, polyurethane, fluorine, polyvinyl alcohol, a silicone, a NBR, an EPDM, a CR, an IR, a BR, or a hydrin rubber, and the resin or the rubber mixed with an electroconductive filler, an insulating filler, an additive, or the like is also permitted.

Further, in the present invention, as the charging unit employing the non-abutment charging method, there may be used a corona charging device including a grid electrode at an opening portion in order to release corona ions to form corona discharge between the surfaces of the electrophotographic photosensitive member 9 and the charging roller 10. In the corona charging device, the width of the grid electrode (opening portion) in the electrophotographic photosensitive member rotational axis direction matches with the width of the area to be charged in the electrophotographic photosensitive member rotational axis direction.

A roller produced as follows may be used as the developing roller 22: the top of the outer periphery of a mandrel formed of a good electroconductor, such as a metal, is covered with a layer serving as an elastic layer, the layer being obtained by blending an elastic rubber, such as an EPDM, a silicone rubber, or a polyurethane rubber, or a foam thereof with an electroconductive material, such as carbon black, for imparting electroconductivity. Further, a roller produced as follows may be used: the top of the outer periphery of the elastic layer is covered with a coating film blended with an electroconductive material or resin particles for the purpose of controlling the amount in which the developer adheres to the surface of the developing roller.

<Process Cartridge>

Figure 2:
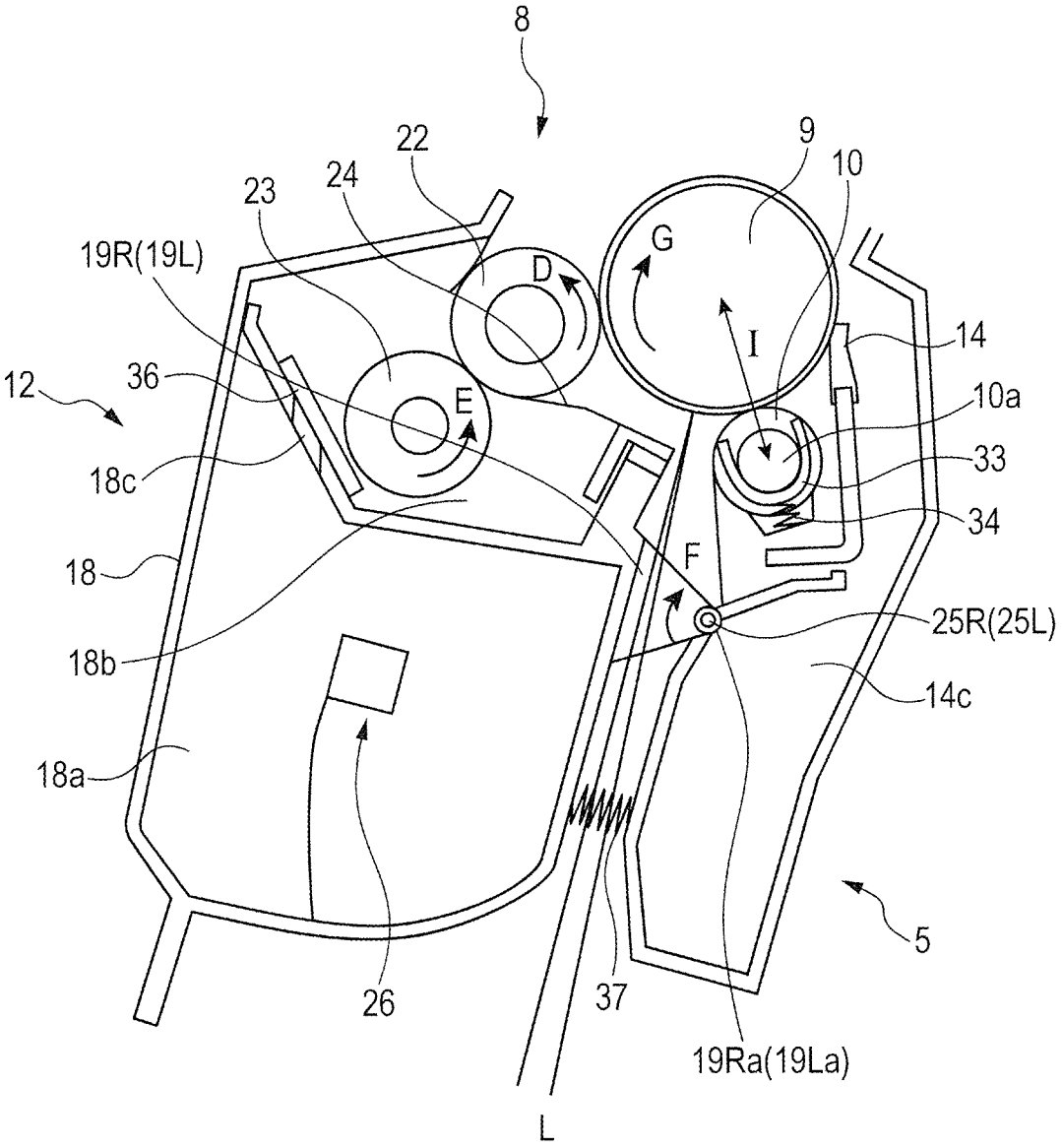
FIG. 2 is a schematic sectional view of a process cartridge according to the embodiment of the present invention.

Next, with reference to FIG. 2, the entire configuration of the process cartridge 8 to be mounted to the electrophotographic apparatus 100 of the present invention is described. FIG. 2 is a schematic sectional view of the process cartridge 8 under a state in which the electrophotographic photosensitive member 9 and the developing roller 22 are brought into abutment against each other.

In this case, a longitudinal direction of the process cartridge 8 or a member forming the cartridge refers to a rotational axis direction or a direction parallel thereto. In FIG. 3 and FIG. 4, the relationships among the surface layer formed area, the charge generating layer formed area, the charging area, and the transfer member abutment area of the electrophotographic photosensitive member are illustrated.

The process cartridge 8 includes a cleaning frame member 5 including the electrophotographic photosensitive member 9 and other members, and the developing unit 12 including the developing roller 22 and other members. The cleaning frame member 5 includes a first frame member serving as a frame member configured to support various elements inside the cleaning frame member 5. In the cleaning frame member 5, the electrophotographic photosensitive member 9 is mounted rotatably in the arrow G direction of FIG. 2 via a bearing (not shown). Laser light L emitted from the scanner unit provided in the electrophotographic apparatus 100 is radiated to the electrophotographic photosensitive member 9 in the cleaning frame member 5.

Further, in the cleaning frame member 5, the charging roller 10 and the cleaning blade 14 are arranged so as to be in abutment against the circumferential surface of the electrophotographic photosensitive member 9. The transfer residual toner removed from the surface of the electrophotographic photosensitive member 9 by the cleaning blade 14 drops into the removal toner chamber 14*c*. Further, in the cleaning frame member 5, a charging roller bearing 33 is mounted along a line passing through a rotary center of the charging roller 10 and a rotary center of the electrophotographic photosensitive member 9.

In this case, the charging roller bearing 33 is mounted movably in an arrow I direction of FIG. 2. A rotary shaft 10*a* of the charging roller 10 is rotatably mounted to the charging roller bearing 33. Further, the charging roller bearing 33 is biased toward the electrophotographic photosensitive member 9 by a charging roller pressurizing spring 34 serving as a biasing unit.

Meanwhile, the developing unit 12 includes a developing frame member 18 configured to support various elements in the developing unit 12. In the developing unit 12, the developing roller 22 is arranged as a developer carrying member that is brought into abutment against the electrophotographic photosensitive member 9 to rotate in an arrow D direction (counterclockwise direction) of FIG. 2. The developing roller 22 is rotatably supported by the developing frame member 18 at both ends in the longitudinal direction (rotational axis direction) of the developing roller 22 via developing bearings (not shown). In this case, the developing bearings are mounted to both side portions of the developing frame member 18.

The developing unit 12 includes a developer storing chamber (hereinafter referred to as a toner storing chamber) 18*a* and a developing chamber 18*b* in which the developing roller 22 is arranged. An opening 18*c* is formed in a partition wall for separating the toner storing chamber 18*a* from the developing chamber 18*b*. When the process cartridge 8 is shipped, a developer sealing member 36 for preventing the toner inside the toner storing chamber 18*a* from being scattered to the outside of the process cartridge 8 is arranged so as to cover the opening 18*c* from the developing chamber 18*b* side.

After the process cartridge 8 is mounted to the electrophotographic apparatus 100, the developer sealing member 36 is pulled in the longitudinal direction via a drive train (not shown) of the process cartridge 8. Thus, the opening 18*c* is uncovered. In the developing chamber 18*b*, a toner supply roller 23 and a developing blade 24 are arranged. The toner supply roller 23 serves as a developer supply member that is brought into abutment against the developing roller 22 to rotate in an arrow E direction. The developing blade 24 serves as a developer regulating member configured to regulate a toner layer of the developing roller 22. Further, in the toner storing chamber 18*a* of the developing frame member 18, a stirring member 26 is arranged for stirring the stored toner and conveying the toner to the toner supply roller 23.

Further, the developing unit 12 is coupled to the cleaning frame member 5 so as to be turnable about fitting shafts 25 (25R and 25L) fitted to holes 19Ra and 19La formed in bearing members 19R and 19L. Further, the developing unit 12 is biased by a pressurizing spring 37. Therefore, during the image formation of the process cartridge 8, the developing unit 12 is rotated in an arrow F direction about the fitting shafts 25 such that the electrophotographic photosensitive member 9 and the developing roller 22 are brought into abutment against each other.

The electrophotographic photosensitive member to be used in the present invention has the charge generating layer and the surface layer formed on the charge generating layer. The charge generating layer is formed on a support. A photosensitive layer comes in a single-layer photosensitive layer obtained by incorporating a charge generating substance and a charge transporting substance into a single layer, and a laminated photosensitive layer obtained by laminating a charge generating layer containing the charge generating substance and a charge transporting layer containing the charge transporting substance. In the present invention, the laminated photosensitive layer is preferred. In addition, an undercoat layer may be arranged between the support and the photosensitive layer as required.

[Support]

A support having electroconductivity (electroconductive support) is preferred as the support. For example, a metallic support formed of a metal or an alloy, such as aluminum, an aluminum alloy, or stainless steel, may be used. When aluminum or the aluminum alloy is used, an aluminum tube produced by a production method including an extruding step and a drawing step, or an aluminum tube produced by a production method including an extruding step and a squeezing step may be used. In addition, the support is preferably cylindrical.

[Electroconductive Layer]

An electroconductive layer may be formed between the support and the undercoat layer or the photosensitive layer for the purpose of covering a defect of the support, such as a convex protrusion (burr) or a recess, occurring on the surface of the support at the time of the formation of the support. The electroconductive layer is obtained by: forming a coating film of an application liquid for an electroconductive layer, which is obtained by dispersing electroconductive particles in a binder resin, on the support; and drying the coating film. Examples of the electroconductive particles include: carbon black; acetylene black; metal particles of aluminum, nickel, iron, nichrome, copper, zinc, and silver; and metal oxide particles of electroconductive tin oxide and indium tin oxide (ITO).

In addition, examples of the binder resin include a polyester resin, a polycarbonate resin, a polyvinyl butyral resin, an acrylic resin, a silicone resin, an epoxy resin, a melamine resin, a urethane resin, a phenol resin, and an alkyd resin.

As a solvent for the application liquid for an electroconductive layer, there are given, for example, an ether-based solvent, an alcohol-based solvent, a ketone-based solvent, and an aromatic hydrocarbon solvent. The thickness of the electroconductive layer is preferably 0.2 μm or more and 40 μm or less, more preferably 1 μm or more and 35 μm or less, still more preferably 5 μm or more and 30 μm or less.

[Undercoat Layer]

An undercoat layer having an electric barrier property may be arranged between the electroconductive layer and the photosensitive layer for inhibiting the injection of charge from the electroconductive layer into the photosensitive layer.

The undercoat layer may be formed by: applying an application liquid for an undercoat layer containing a resin (binder resin) onto the electroconductive layer to form a coating film; and drying the coating film.

Examples of the resin to be used in the undercoat layer include polyvinyl alcohol, polyvinyl methyl ether, a polyacrylic acid, methyl cellulose, ethyl cellulose, polyglutamic acid, casein, polyamide, polyimide, polyamide-imide, polyamide acid, a melamine resin, an epoxy resin, polyurethane, and polyglutamic acid ester. Of those, thermoplastic resins are preferred. Of the thermoplastic resins, polyamide is preferred. As the polyamide, a copolymerized nylon is preferred.

The thickness of the undercoat layer is preferably 0.1 m or more and 2 μm or less. In addition, an electron transporting substance (an electron accepting substance, such as an acceptor) may be incorporated into the undercoat layer.

[Photosensitive Layer]

The photosensitive layer is arranged on the electroconductive layer or the undercoat layer.

Examples of the charge generating substance to be used in the charge generating layer in the photosensitive layer include an azo pigment, a phthalocyanine pigment, an indigo pigment, a perylene pigment, a polycyclic quinone pigment, a squarylium coloring matter, a pyrylium salt, a thiopyrylium salt, a triphenylmethane coloring matter, a quinacridone pigment, an azulenium salt pigment, a cyanine dye, a xanthene coloring matter, a quinone imine coloring matter, and a styryl coloring matter. Of those, metal phthalocyanines, such as oxytitanium phthalocyanine, hydroxygallium phthalocyanine, and chlorogallium phthalocyanine, are preferred.

When the photosensitive layer is a laminated photosensitive layer, the charge generating layer may be formed by: applying an application liquid for a charge generating layer, which is obtained by dispersing the charge generating substance in a solvent together with a binder resin, to form a coating film; and drying the resultant coating film. A method for the dispersion is, for example, a method involving using a homogenizer, an ultrasonic wave, a ball mill, a sand mill, an attritor, a roll mill, or the like.

Examples of the binder resin to be used in the charge generating layer include polycarbonate, polyester, polyarylate, a butyral resin, polystyrene, polyvinyl acetal, a diallyl phthalate resin, an acrylic resin, a methacrylic resin, a vinyl acetate resin, a phenol resin, a silicone resin, polysulfone, a styrene-butadiene copolymer, an alkyd resin, an epoxy resin, a urea resin, and a vinyl chloride-vinyl acetate copolymer. One kind of those resins may be used alone, or two or more kinds thereof may be used as a mixture or a copolymer.

A mass ratio between the charge generating substance and the binder resin (charge generating substance:binder resin) preferably falls within the range of from 10:1 to 1:10, and more preferably falls within the range of from 5:1 to 1:1.

Examples of the solvent to be used in the application liquid for a charge generating layer include an alcohol, a sulfoxide, a ketone, an ether, an ester, an aliphatic halogenated hydrocarbon, and an aromatic compound.

The thickness of the charge generating layer is preferably 5 μm or less, more preferably 0.1 μm or more and 2 μm or less.

In addition, various sensitizers, antioxidants, UV absorbers, and plasticizers may each be added to the charge generating layer as required. In addition, in order that the flow of charge may be prevented from stagnating in the charge generating layer, an electron transporting substance (an electron accepting substance, such as an acceptor) may be incorporated into the charge generating layer. The electron transporting substance is, for example, the same substance as the above-mentioned electron transporting substance to be used in the undercoat layer.

The charge generating layer is formed by: applying the application liquid for a charge generating layer onto the support, the electroconductive layer, or the undercoat layer to form a coating film; and drying the coating film. Specifically, the coating film is formed by applying the application liquid for a charge generating layer to the central portion of the support (area except both end portions in the axial direction of the support) so that an area exposed to the outside where the coating film of the application liquid for a charge generating layer is not formed may be arranged in each of both the end portions in the axial direction of the support. Alternatively, the coating film of the application liquid for a charge generating layer is formed, and both end portions in the axial direction of the coating film of the application liquid for a charge generating layer are wiped off with a solvent and a wiping member, such as a brush, a sponge, or a blade, so that areas where both the end portions in the axial direction of the coating film are exposed to the outside may be arranged. After that, the resultant is dried. Thus, the layer is formed.

Examples of the charge transporting substance to be used in the charge transporting layer in the photosensitive layer include a triarylamine compound, a hydrazone compound, a styryl compound, a stilbene compound, a pyrazoline compound, an oxazole compound, a thiazole compound, and a triarylmethane compound.

When the photosensitive layer is a laminated photosensitive layer, the charge transporting layer may be formed by: applying an application liquid for a charge transporting layer, which is obtained by mixing the charge transporting substance and a binder resin with a solvent, to form a coating film; and drying the resultant coating film.

Examples of the binder resin to be used in the charge transporting layer include an acrylic resin, a styrene resin, polyester, polycarbonate, polyarylate, polysulfone, polyphenylene oxide, an epoxy resin, polyurethane, and an alkyd resin. One kind of those resins may be used alone, or two or more kinds thereof may be used as a mixture or a copolymer. Of those, thermoplastic resins are preferably used, and polycarbonate and polyarylate are more preferably used.

A mass ratio between the charge transporting substance and the binder resin (charge transporting substance:binder resin) preferably falls within the range of from 2:1 to 1:2.

Examples of the solvent to be used in the application liquid for a charge transporting layer include a ketone solvent, an ester solvent, an ether solvent, an aromatic hydrocarbon solvent, and a hydrocarbon solvent substituted with a halogen atom.

The thickness of the charge transporting layer is preferably 3 μm or more and 40 μm or less, more preferably 4 μm or more and 30 μm or less.

In addition, antioxidants, UV absorbers, and plasticizers may each be added to the charge transporting layer as required.

In addition, a protective layer may be arranged on the photosensitive layer for the purpose of protecting the photosensitive layer. The protective layer may be formed by: applying an application liquid for a protective layer containing a resin (binder resin) to form a coating film; and drying and/or curing the resultant coating film. In the present invention, the surface layer is a layer on the outermost surface side of the electrophotographic photosensitive member. When the protective layer is present, the surface layer is the protective layer, and when the protective layer is absent, the surface layer is the charge transporting layer. The protective layer as the surface layer is preferably formed on the charge transporting layer.

The thickness of the protective layer is preferably 0.5 μm or more and 10 μm or less, more preferably 1 μm or more and 8 μm or less.

When the application liquid for each of the layers is applied, an immersion application method (immersion coating method), a spray coating method, a spinner coating method, a roller coating method, a Mayer bar coating method, a blade coating method, or the like may be used.

Now, the present invention is described in more detail by way of specific Examples. However, the present invention is not limited thereto. The term "part(s)" in Examples and Comparative Examples refers to "part(s) by mass."

Example 1

An aluminum cylinder (JIS-A3003, aluminum alloy) having a length of 260.5 mm, a diameter of 24 mm, and a wall thickness of 1.0 mm, the cylinder being produced by a production method including an extruding step and a drawing step, was used as a support (cylindrical electroconductive support).

Next, 214 parts of titanium oxide ($TiO_2$) particles covered with oxygen-deficient tin oxide ($SnO_2$), 132 parts of a phenol resin (trade name: PLYOPHEN J-325, manufactured by DIC Corporation (formerly Dainippon Ink and Chemicals, Inc.), resin solid content: 60 mass %), and 98 parts of 1-methoxy-2-propanol serving as a solvent were loaded into a sand mill using 450 parts of glass beads each having a diameter of 0.8 mm, and were subjected to a dispersion treatment under the conditions of a number of revolutions of 2,000 rpm, a dispersion treatment time of 4.5 hours, and a preset temperature of cooling water of 18° C. to provide a dispersion liquid. The glass beads were removed from the dispersion liquid with a mesh (aperture: 150 μm).

Silicone resin particles (trade name: TOSPEARL 120, manufactured by Momentive Performance Materials Inc., average particle diameter: 2 μm) were added to the dispersion liquid after the removal of the glass beads so that their content became 10 mass % with respect to the total mass of the titanium oxide particles and the phenol resin in the dispersion liquid. Further, a silicone oil (trade name: SH28PA, manufactured by Dow Corning Toray Co., Ltd.) was added to the dispersion liquid so that its content became 0.01 mass % with respect to the total mass of the titanium oxide particles and the phenol resin in the dispersion liquid, followed by stirring. Thus, an application liquid for an electroconductive layer was prepared. The application liquid for an electroconductive layer was applied onto the support by immersion, and the resultant coating film was dried and thermally cured for 30 minutes at 150° C. to form an electroconductive layer having a thickness of 30 μm.

Next, an application liquid for an undercoat layer was prepared by dissolving 4.5 parts of N-methoxymethylated nylon (trade name: TORESIN EF-30T, manufactured by Teikoku Kagaku Sangyo K.K.) and 1.5 parts of a copolymerized nylon resin (trade name: AMILAN CM8000, manufactured by Toray Industries, Inc.) in a mixed solvent containing 65 parts of methanol and 30 parts of n-butanol. The application liquid for an undercoat layer was applied onto the electroconductive layer by immersion, and the resultant coating film was dried for 6 minutes at 70° C. to form an undercoat layer having a thickness of 0.85 μm.

Next, a hydroxygallium phthalocyanine crystal (charge generating substance) of a crystal form having peaks at Bragg angles (2θ±0.2°) in CuKα characteristic X-ray diffraction of 7.5°, 9.9°, 16.3°, 18.6°, 25.1°, and 28.3° was prepared. 10 Parts of the hydroxygallium phthalocyanine crystal, 5 parts of polyvinyl butyral (trade name: S-LEC BX-1, manufactured by Sekisui Chemical Co., Ltd.), and 250 parts of cyclohexanone were loaded into a sand mill using glass beads each having a diameter of 1 mm, and were subjected to a dispersion treatment under the condition of a dispersion treatment time of 3 hours. After the dispersion, the glass beads were removed, and then an application liquid for a charge generating layer was prepared by adding 250 parts of ethyl acetate to the residue. The application liquid for a charge generating layer was applied onto the undercoat layer by immersion, and its coating film was wiped off with lens-cleaning paper having adhered thereto methyl ethyl ketone (MEK) so that the L4 became 115.0 mm. Then, the resultant coating film was dried for 10 minutes at 100° C. to form a charge generating layer having a thickness of 0.12 μm.

Next, an application liquid for a charge transporting layer was prepared by dissolving 9 parts of an amine compound (hole transporting substance) represented by the following formula (CT-1) and 10 parts of a polyarylate resin having a structural unit represented by the following formula (B1) and a structural unit represented by the following formula (B2) at a ratio of 5/5, and having a weight-average molecular weight (Mw) of 100,000 in a mixed solvent containing 30 parts of dimethoxymethane and 70 parts of chlorobenzene. The application liquid for a charge transporting layer was applied onto the charge generating layer by immersion, and its coating film was wiped off with lens-cleaning paper having adhered thereto MEK so that the L3 became 125.0 mm. The resultant coating film was dried for 40 minutes at 120° C. to form a charge transporting layer having a thickness of 15 μm. Thus, an electrophotographic photosensitive member was produced.

(CT-1)

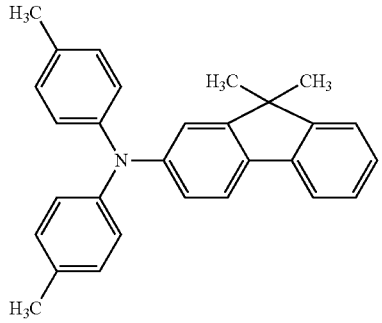

(B1)

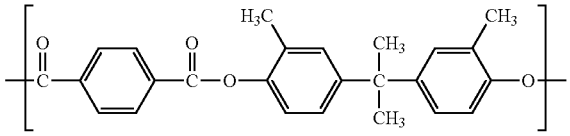

(B2)

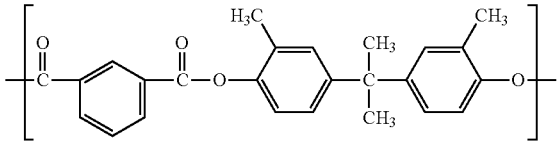

Next, the evaluation method is described. A laser beam printer (manufactured by Hewlett-Packard Company, Color LaserJet CP3525dn, abutment one-component developing method) was modified for use as an apparatus for evaluation. The laser beam printer was modified such that a cylindrical rotatable gap forming member that was made of a polyoxymethylene (POM) material and had a width of 3 mm was mounted to the end of the charging roller, to thereby secure a gap of 100 μm between the surface of the charging roller and the surface of the electrophotographic photosensitive member. Further, the charging area of the surface of the electrophotographic photosensitive member was set to L1=120.0 mm, and the peripheral speed difference of the charging roller with respect to the electrophotographic photosensitive member was set to 100%. A voltage obtained by superimposing an AC voltage on a DC voltage was applied to the charging roller, and an AC bias was set to 2.0 kHz and 2.0 kVpp. Further, setting was made such that, after the electrophotographic photosensitive member was charged, the photosensitive member surface potential at the image center at the developing position was −600 V. The width in which the primary transfer roller was opposed to the electrophotographic photosensitive member was set to L2=110.0 mm. Further, the cleaning blade was brought into abutment against the electrophotographic photosensitive member to obtain L5=124.0 mm.

Repeated image formation was evaluated with use of the above-mentioned apparatus. The image formation of a printing ratio of 1% was evaluated in a 2-sheet intermittent mode for 30,000 letter sheets (each having a sheet size width of 215.9 mm) under an environment with a temperature of 23° C. and a humidity of 50% RH. The image subjected to repeated image formation evaluation was observed to observe the occurrence of a black lateral streak. Further, the thickness of the electrophotographic photosensitive member was measured before and after the repeated image formation was performed, and the wear amount of the most worn part in the vicinity of the end of the charging area (on both end sides) was set to D (μm). In Example 1, L1 to L5 were set such that, in the longitudinal direction of the electrophotographic photosensitive member, the lengths of L1 to L5 from the center of the image forming area to one end side were respectively the same as the lengths of L1 to L5 from the center of the image forming area to the other end side.

As an apparatus for measuring the thickness of each layer of the electrophotographic photosensitive member, FISCHERSCOPE MMS manufactured by Fischer Instruments K.K. was used.

The values of L1 to L5, the wear amount D, and the image evaluation result in Example 1 are shown in Table 1.

Examples 2 to 9

An electrophotographic photosensitive member was manufactured by a similar method except that L2 and L4 were changed from those in Example 1, and the evaluation was performed with a similar evaluation machine. The values of L1 to L5, the wear amount D, and the image evaluation results at this time are shown in Table 1.

Example 10

The electrophotographic photosensitive member manufactured in Example 1 was evaluated while changing the evaluation machine as described below. The values of L1 to L5, the wear amount D, and the image evaluation result at this time are shown in Table 1.

A laser beam printer (Color LaserJet CP3525dn, abutment one-component developing method) was modified for use as the evaluation machine. A scorotron charging device was used as the charging device, and setting was made such that, after a total current amount of a wire was charged to the electrophotographic photosensitive member, the photosensitive member surface potential at the center of the image forming area at the developing position was −600 V. Further, the charging area of the surface of the electrophotographic photosensitive member was set to L1=120.0 mm. The width in which the primary transfer roller was opposed to the electrophotographic photosensitive member was set to L2=110.0 mm. Further, the cleaning blade was brought into abutment against the electrophotographic photosensitive member to obtain L5=124.0 mm.

Repeated image formation was evaluated with use of the above-mentioned apparatus. The image formation of a printing ratio of 1% was evaluated in a 2-sheet intermittent mode for 30,000 letter sheets (each having a sheet size width of 215.9 mm) under an environment with a temperature of 23° C. and a humidity of 50% RH. Further, the thickness of the electrophotographic photosensitive member was measured before and after the repeated image formation was performed, and the wear amount of the most worn part in the vicinity of the end of the charging roller (on both end sides) was set to D (μm). In Example 10, L1 to L5 were set such that, in the longitudinal direction of the electrophotographic photosensitive member, the lengths of L1 to L5 from the center of the image forming area to one end side were respectively the same as the lengths of L1 to L5 from the center of the image forming area to the other end side.

As the apparatus for measuring the thickness of each layer of the electrophotographic photosensitive member, FISCHERSCOPE MMS manufactured by Fischer Instruments K.K. was used.

Example 11

The electrophotographic photosensitive member manufactured in Example 1 was evaluated while changing the evaluation machine and the evaluation method as described below. The values of L1 to L5, the wear amount D, and the image evaluation result at this time are shown in Table 1.

As the evaluation machine, a laser beam printer (Color LaserJet CP3525dn, abutment one-component developing method) was modified such that a cylindrical rotatable gap forming member that was made of a POM material and had a width of 2 mm was mounted to the end of the charging roller, to thereby secure a gap of 100 μm between the surface of the charging roller and the surface of the electrophotographic photosensitive member. Further, the charging area of the surface of the electrophotographic photosensitive member was set to L1=120.0 mm, and the peripheral speed difference of the charging roller with respect to the electrophotographic photosensitive member was set to 100%. A voltage obtained by superimposing an AC voltage on a DC voltage was applied to the charging roller, and an AC bias was set to 2.0 kHz and 2.0 kVpp. Further, setting was made such that, after the electrophotographic photosensitive member was charged, the photosensitive member surface potential at the center of the image forming area at the developing position was −600 V. The width in which the primary transfer roller was opposed to the electrophotographic photosensitive member was set to L2=110.0 mm. Further, the cleaning member was removed. The width in which the developing roller was brought into abutment against the electrophotographic photosensitive member was set to L5=124.0 mm, and the peripheral speed difference of the developing roller with respect to the electrophotographic photosensitive member was set to 150%. Further, the developing roller applied a double abutment pressure to the electrophotographic photosensitive member.

Repeated image formation was evaluated with use of the above-mentioned apparatus. The image formation of a printing ratio of 1% was evaluated in a 2-sheet intermittent mode for 30,000 letter sheets (each having a sheet size width of 215.9 mm) under an environment with a temperature of 23° C. and a humidity of 50% RH. Further, the toner adhered to a member was removed every 5,000 sheets. The image subjected to repeated image formation evaluation was observed to observe the occurrence of a black lateral streak. Further, the thickness of the electrophotographic photosensitive member was measured before and after the repeated image formation was performed, and the wear amount of the most worn part in the vicinity of the end of the charging roller (on both end sides) was set to D (μm). In Example 11, L1 to L5 were set such that, in the longitudinal direction of the electrophotographic photosensitive member, the lengths of L1 to L5 from the center of the image forming area to one end side were respectively the same as the lengths of L1 to L5 from the center of the image forming area to the other end side.

As the apparatus for measuring the thickness of each layer of the electrophotographic photosensitive member, FISCHERSCOPE MMS manufactured by Fischer Instruments K.K. was used.

Example 12

The electrophotographic photosensitive member manufactured in Example 1 was similarly evaluated except that the evaluation machine was changed as described below. The values of L1 to L5, the wear amount D, and the image evaluation result at this time are shown in Table 1.

A laser beam printer (Color LaserJet CP3525dn, abutment one-component developing method) was modified for use as the evaluation machine. A scorotron charging device was used as the charging device, and setting was made such that, after a total current amount of a wire was charged to the electrophotographic photosensitive member, the photosensitive member surface potential at the center of the image forming area at the developing position was −600 V. Further, the charging area of the surface of the electrophotographic photosensitive member was set to L1=120.0 mm. The width in which the primary transfer roller was opposed to the electrophotographic photosensitive member was set to L2=110.0 mm. Further, the cleaning member was removed. The width in which the developing roller was brought into abutment against the electrophotographic photosensitive member was set to L5=124.0 mm, and the peripheral speed difference of the developing roller with respect to the electrophotographic photosensitive member was set to 150%. Further, the developing roller applied a double abutment pressure to the electrophotographic photosensitive member.

Repeated image formation was evaluated with use of the above-mentioned apparatus. The image formation of a printing ratio of 1% was evaluated in a 2-sheet intermittent mode for 30,000 letter sheets (each having a sheet size width of 215.9 mm) under an environment with a temperature of 23° C. and a humidity of 50% RH. Further, the toner adhered to a member was removed every 5,000 sheets. The image subjected to repeated image formation evaluation was observed to observe the occurrence of a black lateral streak. Further, the thickness of the electrophotographic photosensitive member was measured before and after the repeated image formation was performed, and the wear amount of the most worn part in the vicinity of the end of the charging area (on both end sides) was set to D (μm). In Example 12, L1 to L5 were set such that, in the longitudinal direction of the electrophotographic photosensitive member, the lengths of L1 to L5 from the center of the image forming area to one end side were respectively the same as the lengths of L1 to L5 from the center of the image forming area to the other end side.

As the apparatus for measuring the thickness of each layer of the electrophotographic photosensitive member, FISCHERSCOPE MMS manufactured by Fischer Instruments K.K. was used.

Example 13

The electrophotographic photosensitive member was similarly manufactured except that the cylindrical electroconductive supporting members L1, L2, and L4, and the evaluation machine in Example 1 were changed as described below. The values of L1 to L5, the wear amount D, and the image evaluation result at this time are shown in Table 1.

An aluminum cylinder (JIS-A3003, aluminum alloy) having a length of 260.5 mm, a diameter of 30 mm, and a wall thickness of 1.0 mm, the cylinder being produced by a production method including an extruding step and a drawing step, was used as a support (cylindrical electroconductive support).

A laser beam printer (trade name: HP LaserJet Enterprise 600 M603, non-abutment one-component developing method) was modified for use as the evaluation machine. The laser beam printer was modified such that a cylindrical rotatable gap forming member that was made of a POM material and had a width of 2 mm was mounted to the end of the charging roller, to thereby secure a gap of 100 μm between the surface of the charging roller and the surface of the electrophotographic photosensitive member. Further, the charging area of the surface of the electrophotographic photosensitive member was set to L1=110.0 mm, and the peripheral speed difference of the charging roller with respect to the electrophotographic photosensitive member was set to 100%. A voltage obtained by superimposing an AC voltage on a DC voltage was applied to the charging roller, and an AC bias was set to 2.0 kHz and 2.0 kVpp. Further, setting was made such that, after the electrophotographic photosensitive member was charged, the photosensitive member surface potential at the center of the image forming area at the developing position was −600 V. The width in which the primary transfer roller was opposed to the electrophotographic photosensitive member was set to L2=100.0 mm. Further, the cleaning blade was brought into abutment against the electrophotographic photosensitive member to obtain L5=124.0 mm.

Repeated image formation was evaluated with use of the above-mentioned apparatus. The repeated image formation of a printing ratio of 1% was performed in a 2-sheet intermittent mode for 30,000 letter sheets (each having a sheet size width of 215.9 mm) under an environment with a temperature of 23° C. and a humidity of 50% RH. The image subjected to repeated image formation evaluation was observed to observe the occurrence of a black lateral streak. Further, the thickness of the electrophotographic photosensitive member was measured before and after the repeated image formation was performed, and the wear amount of the most worn part in the vicinity of the end of the charging area (measured at eight points in the circumferential direction at intervals of 1 mm and 5 mm from both end sides) was set to D (μm). In Example 13, L1 to L5 were set such that, in the longitudinal direction of the electrophotographic photosensitive member, the lengths of L1 to L5 from the center of the image forming area to one end side were respectively the same as the lengths of L1 to L5 from the center of the image forming area to the other end side.

Example 14

The electrophotographic photosensitive member was similarly manufactured except that L1 and the evaluation machine in Example 13 were changed as described below. The values of L1 to L5, the wear amount D, and the image evaluation result at this time are shown in Table 1.

A laser beam printer (trade name: HP LaserJet Enterprise 600 M603, non-abutment one-component developing method) was modified for use as the evaluation machine. A scorotron charging device was used as the charging device, and setting was made such that, after a total current amount of a wire was charged to the electrophotographic photosensitive member, the photosensitive member surface potential at the center of the image forming area at the developing position was −600 V. Further, the charging area of the surface of the electrophotographic photosensitive member was set to L1=110.0 mm. The width in which the primary transfer roller was opposed to the electrophotographic photosensitive member was set to L2=100.0 mm. Further, the cleaning blade was brought into abutment against the electrophotographic photosensitive member to obtain L5=124.0 mm.

Repeated image formation was evaluated with use of the above-mentioned apparatus. The repeated image formation of a printing ratio of 1% was performed in a 2-sheet intermittent mode for 30,000 letter sheets (each having a sheet size width of 215.9 mm) under an environment with a temperature of 23° C. and a humidity of 50% RH. The image subjected to repeated image formation evaluation was observed to observe the occurrence of a black lateral streak.

Further, the thickness of the electrophotographic photosensitive member was measured before and after the repeated image formation was performed, and the wear amount of the most worn part in the vicinity of the end of the charging device (measured at eight points in the circumferential direction at intervals of 1 mm and 5 mm from both end sides) was set to D (μm). In Example 14, L1 to L5 were set such that, in the longitudinal direction of the electrophotographic photosensitive member, the lengths of L1 to L5 from the center of the image forming area to one end side were respectively the same as the lengths of L1 to L5 from the center of the image forming area to the other end side.

Example 15

An aluminum cylinder (JIS-A3003, aluminum alloy) having a length of 370.0 mm and a diameter of 84 mm, the cylinder being produced by a production method including an extruding step and a drawing step, was subjected to cutting processing, and the resultant was used as a support (cylindrical electroconductive support).

Next, 214 parts of titanium oxide ($TiO_2$) particles covered with oxygen-deficient tin oxide ($SnO_2$), 132 parts of a phenol resin (trade name: PLYOPHEN J-325, manufactured by DIC Corporation (formerly Dainippon Ink and Chemicals, Inc.), resin solid content: 60 mass %), and 98 parts of 1-methoxy-2-propanol serving as a solvent were loaded into a sand mill using 450 parts of glass beads each having a diameter of 0.8 mm, and were subjected to a dispersion treatment under the conditions of a number of revolutions of 2,000 rpm, a dispersion treatment time of 4.5 hours, and a preset temperature of cooling water of 18° C. to provide a dispersion liquid.

The glass beads were removed from the dispersion liquid with a mesh (aperture: 150 μm).

Silicone resin particles (trade name: TOSPEARL 120, manufactured by Momentive Performance Materials Inc., average particle diameter: 2 μm) were added to the dispersion liquid after the removal of the glass beads so that their content became 2 mass % with respect to the total mass of the titanium oxide particles and the phenol resin in the dispersion liquid. Further, a silicone oil (trade name: SH28PA, manufactured by Dow Corning Toray Co., Ltd.) was added to the dispersion liquid so that its content became 0.01 mass % with respect to the total mass of the titanium oxide particles and the phenol resin in the dispersion liquid, followed by stirring. Thus, an application liquid for an electroconductive layer was prepared. The application liquid for an electroconductive layer was applied onto the support by immersion, and the resultant coating film was dried and thermally cured for 30 minutes at 150° C. to form an electroconductive layer having a thickness of 18 μm.

Next, an application liquid for an undercoat layer was prepared by dissolving 40 parts of N-methoxymethylated nylon (trade name: TORESIN EF-30T, manufactured by Teikoku Kagaku Sangyo K.K.) in a mixed solvent containing 400 parts of methanol and 200 parts of n-butanol. The application liquid for an undercoat layer was applied onto the electroconductive layer by immersion, and the resultant coating film was dried for 30 minutes at 100° C. to form an undercoat layer having a thickness of 0.40 μm.

Next, a hydroxygallium phthalocyanine crystal (charge generating substance) of a crystal form having peaks at Bragg angles (2θ±0.2°) in CuKα characteristic X-ray diffraction of 7.5°, 9.9°, 16.3°, 18.6°, 25.1°, and 28.3° was prepared.

20 Parts of the hydroxygallium phthalocyanine crystal, 0.2 part of a compound represented by the following formula (A), 10 parts of polyvinyl butyral (trade name: S-LEC BX-1, manufactured by Sekisui Chemical Co., Ltd.), and 800 parts of cyclohexanone were loaded into a sand mill using glass beads each having a diameter of 1 mm, and were subjected to a dispersion treatment under the condition of a dispersion treatment time of 4 hours. After the dispersion, the glass beads were removed, and then an application liquid for a charge generating layer was prepared by adding 700 parts of ethyl acetate to the residue. The application liquid for a charge generating layer was applied onto the undercoat layer by immersion, and its coating film was wiped off with lens-cleaning paper having adhered thereto MEK so that the L4 became 159.0 mm. The resultant coating film was dried for 10 minutes at 100° C. to form a charge generating layer having a thickness of 0.18 μm.

(A)

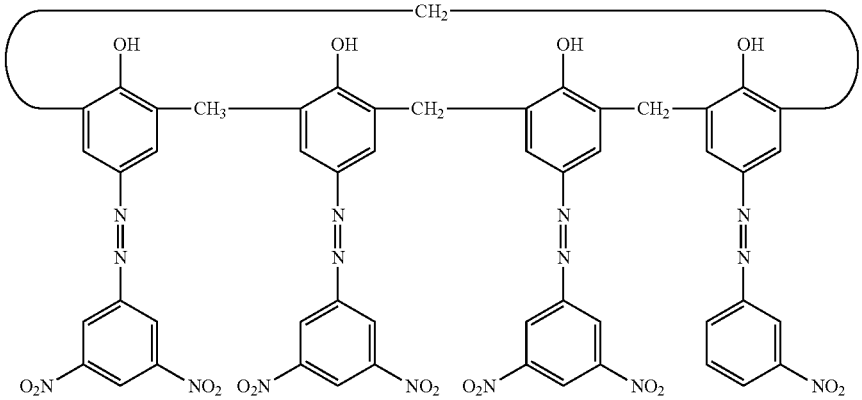

Next, an application liquid for a charge transporting layer was prepared by dissolving 72 parts of the amine compound represented by the formula (CT-1), 8 parts of an amine compound (hole transporting substance) represented by the following formula (CT-2), and 100 parts of a polyarylate resin having a structural unit represented by the following formula (B3) and a structural unit represented by the following formula (B4) at a ratio of 7/3, and having a weight-average molecular weight (Mw) of 130,000 in a mixed solvent containing 300 parts of dimethoxymethane and 600 parts of chlorobenzene. The application liquid for a charge transporting layer was applied onto the charge generating layer by immersion, and its coating film was wiped off with lens-cleaning paper having adhered thereto MEK so that the L3 became 175.0 mm. The resultant coating film was dried for 40 minutes at 120° C. to form a charge transporting layer having a thickness of 15 μm.

(CT-2)

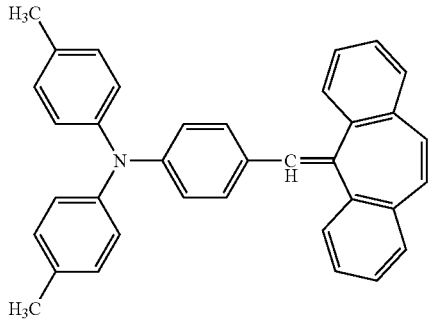

(B3)

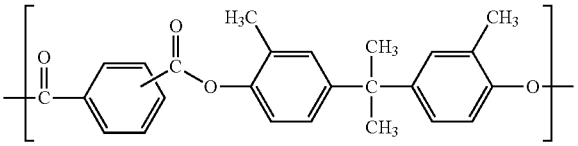

(B4)

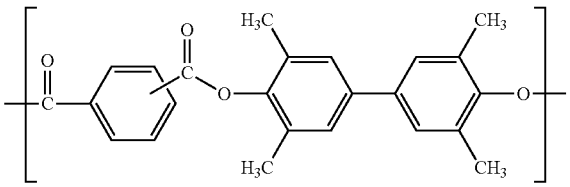

A copying machine manufactured by Canon Inc. (trade name: imagePRESS C1+, two-component developing method) was modified for use as the evaluation machine. The copying machine was modified such that a cylindrical rotatable gap forming member that was made of a POM material and had a width of 4 mm was mounted to the end of the charging roller, to thereby secure a gap of 200 μm between the surface of the charging roller and the surface of the electrophotographic photosensitive member. Further, the charging area of the surface of the electrophotographic photosensitive member was set to L1=167.0 mm, and the peripheral speed difference of the charging roller with respect to the electrophotographic photosensitive member was set to 100%. A voltage obtained by superimposing an AC voltage on a DC voltage was applied to the charging roller, and an AC bias was set to 2.0 kHz and 2.0 kVpp. Further, setting was made such that, after the electrophotographic photosensitive member was charged, the photosensitive member surface potential at the center of the image forming area at the developing position was −700 V. The width in which the primary transfer roller was opposed to the electrophotographic photosensitive member was set to L2=161.0 mm. Further, the cleaning blade was brought into abutment against the electrophotographic photosensitive member to obtain L5=178.0 mm.

Repeated image formation was evaluated with use of the above-mentioned apparatus. The repeated image formation of a printing ratio of 1% was performed in a 2-sheet intermittent mode for 80,000 letter sheets (each having a sheet size width of 279.4 mm) under an environment with a temperature of 23° C. and a humidity of 50% RH. The image subjected to repeated image formation evaluation was observed to observe the occurrence of a black lateral streak. Further, the thickness of the electrophotographic photosensitive member was measured before and after the repeated image formation was performed, and the wear amount of the most worn part in the vicinity of the end of the charging roller (measured at eight points in the circumferential direction at intervals of 1 mm and 5 mm from both end sides) was set to D (μm). In Example 15, L1 to L5 were set such that, in the longitudinal direction of the electrophotographic photosensitive member, the lengths of L1 to L5 from the center of the image forming area to one end side were respectively the same as the lengths of L1 to L5 from the center of the image forming area to the other end side.

Example 16

The electrophotographic photosensitive member was similarly manufactured except that the evaluation machine in Example 15 was changed as described below. The values of L1 to L5, the wear amount D, and the image evaluation result at this time are shown in Table 1.

A copying machine manufactured by Canon Inc. (trade name: imagePRESS C1+, two-component developing method) was modified for use as the evaluation machine.

A scorotron charging device was used as the charging device, and setting was made such that, after a total current amount of a wire was charged to the electrophotographic photosensitive member, the photosensitive member surface potential at the center of the image forming area at the developing position was −700 V. Further, the charging area of the surface of the electrophotographic photosensitive member was set to L1=167.0 mm. The width in which the primary transfer roller was opposed to the electrophotographic photosensitive member was set to L2=161.0 mm. Further, the cleaning blade was brought into abutment against the electrophotographic photosensitive member to obtain L5=178.0 mm.

Repeated image formation was evaluated with use of the above-mentioned apparatus. The repeated image formation of a printing ratio of 1% was performed in a 2-sheet intermittent mode for 80,000 letter sheets (each having a sheet size width of 279.4 mm) under an environment with a temperature of 23° C. and a humidity of 50% RH. The image subjected to repeated image formation evaluation was observed to observe the occurrence of a black lateral streak. Further, the thickness of the electrophotographic photosensitive member was measured before and after the repeated image formation was performed, and the wear amount of the most worn part in the vicinity of the end of the charging roller (measured at eight points in the circumferential direction at intervals of 1 mm and 5 mm from both end sides) was set to D (μm). In Example 16, L1 to L5 were set such that, in the longitudinal direction of the electrophotographic photosensitive member, the lengths of L1 to L5 from the center of the image forming area to one end side were respectively the same as the lengths of L1 to L5 from the center of the image forming area to the other end side.

Comparative Examples 1 and 2

A photosensitive member was manufactured by a similar method except that L2 and L4 were changed from those in Example 1, and the evaluation was performed with a similar evaluation machine. The values of L1 to L5, the wear amount D, and the image evaluation results at this time are shown in Table 1.

Comparative Example 3

A photosensitive member was manufactured by a similar method except that L4 was changed from that in Example 10, and the evaluation was performed with a similar evaluation machine. The values of L1 to L5, the wear amount D, and the image evaluation result at this time are shown in Table 1.

Comparative Example 4

A photosensitive member was manufactured by a similar method except that L4 was changed from that in Example 11, and the evaluation was performed with a similar evaluation machine. The values of L1 to L5, the wear amount D, and the image evaluation result at this time are shown in Table 1.

Comparative Example 5

A photosensitive member was manufactured by a similar method except that L4 was changed from that in Example 12, and the evaluation was performed with a similar evaluation machine. The values of L1 to L5, the wear amount D, and the image evaluation result at this time are shown in Table 1.

Comparative Example 6

A photosensitive member was manufactured by a similar method except that L4 was changed from that in Example 13, and the evaluation was performed with a similar evaluation machine. The values of L1 to L5, the wear amount D, and the image evaluation result at this time are shown in Table 1.

Comparative Example 7

A photosensitive member was manufactured by a similar method except that L4 was changed from that in Example 14, and the evaluation was performed with a similar evaluation machine. The values of L1 to L5, the wear amount D, and the image evaluation result at this time are shown in Table 1.

Comparative Example 8

A photosensitive member was manufactured by a similar method except that L4 was changed from that in Example 15, and the evaluation was performed with a similar evaluation machine. The values of L1 to L5, the wear amount D, and the image evaluation result at this time are shown in Table 1.

Comparative Example 9

A photosensitive member was manufactured by a similar method except that L4 was changed from that in Example 16, and the evaluation was performed with a similar evaluation machine. The values of L1 to L5, the wear amount D, and the image evaluation result at this time are shown in Table 1.

TABLE 1

| | L1 (mm) | L2 (mm) | L3 (mm) | L4 (mm) | L5 (mm) | D (μm) | Image |
|---|---|---|---|---|---|---|---|
| Example 1 | 120.0 | 110.0 | 125.0 | 115.0 | 124.0 | 10.2 | Without black lateral streak |
| Example 2 | 120.0 | 110.0 | 125.0 | 117.0 | 124.0 | 10.8 | Without black lateral streak |
| Example 3 | 120.0 | 110.0 | 125.0 | 113.0 | 124.0 | 11.2 | Without black lateral streak |
| Example 4 | 120.0 | 110.0 | 125.0 | 111.0 | 124.0 | 11.3 | Without black lateral streak |
| Example 5 | 120.0 | 115.0 | 125.0 | 115.0 | 124.0 | 12.9 | Without black lateral streak |
| Example 6 | 120.0 | 113.0 | 125.0 | 111.0 | 124.0 | 11.5 | Without black lateral streak |
| Example 7 | 120.0 | 115.0 | 125.0 | 111.0 | 124.0 | 11.7 | Without black lateral streak |
| Example 8 | 120.0 | 118.0 | 125.0 | 111.0 | 124.0 | 11.6 | Without black lateral streak |
| Example 9 | 120.0 | 110.0 | 125.0 | 118.0 | 124.0 | 12.3 | Without black lateral streak |
| Example 10 | 120.0 | 110.0 | 125.0 | 115.0 | 124.0 | 13.0 | Without black lateral streak |
| Example 11 | 120.0 | 110.0 | 125.0 | 115.0 | 124.0 | 10.5 | Without black lateral streak |
| Example 12 | 120.0 | 110.0 | 125.0 | 115.0 | 124.0 | 13.0 | Without black lateral streak |
| Example 13 | 110.0 | 100.0 | 125.0 | 105.0 | 124.0 | 10.0 | Without black lateral streak |
| Example 14 | 110.0 | 100.0 | 125.0 | 105.0 | 124.0 | 13.0 | Without black lateral streak |
| Example 15 | 167.0 | 161.0 | 180.0 | 164.0 | 178.0 | 10.0 | Without black lateral streak |
| Example 16 | 167.0 | 161.0 | 180.0 | 164.0 | 178.0 | 12.5 | Without black lateral streak |
| Comparative Example 1 | 120.0 | 110.0 | 125.0 | 125.0 | 124.0 | 15.0 | With black lateral streak |
| Comparative Example 2 | 120.0 | 123.0 | 125.0 | 125.0 | 124.0 | 15.0 | With black lateral streak |
| Comparative Example 3 | 120.0 | 110.0 | 125.0 | 125.0 | 124.0 | 15.0 | With black lateral streak |
| Comparative Example 4 | 120.0 | 110.0 | 125.0 | 125.0 | 124.0 | 15.0 | With black lateral streak |
| Comparative Example 5 | 120.0 | 110.0 | 125.0 | 125.0 | 124.0 | 15.0 | With black lateral streak |
| Comparative Example 6 | 110.0 | 100.0 | 125.0 | 125.0 | 124.0 | 15.0 | With black lateral streak |
| Comparative Example 7 | 110.0 | 100.0 | 125.0 | 125.0 | 124.0 | 15.0 | With black lateral streak |
| Comparative Example 8 | 167.0 | 161.0 | 180.0 | 180.0 | 178.0 | 14.0 | With black lateral streak |
| Comparative Example 9 | 167.0 | 161.0 | 180.0 | 180.0 | 178.0 | 14.0 | With black lateral streak |

From the results described above, it is understood that the local wear of the electrophotographic photosensitive member at the end of the charging area is suppressed and an image defect due to this surface wear is suppressed in Examples of the present invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-023765, filed Feb. 10, 2016, which is hereby incorporated by reference herein in its entirety.

What is claimed is:

1. An electrophotographic apparatus, comprising:

an electrophotographic photosensitive member having a cylindrical shape;

a charging unit, which is arranged in a non-abutment manner with respect to the electrophotographic photosensitive member, and is configured to charge the electrophotographic photosensitive member;

a cleaning unit, which is arranged in abutment against the electrophotographic photosensitive member, and is configured to clean a surface of the electrophotographic photosensitive member; and a transferring unit configured to transfer a toner image onto a transfer material, the electrophotographic photosensitive member comprising a charge generating layer and a surface layer in this order, the electrophotographic photosensitive member satisfying Expression (1), Expression (2), and Expression (3):

$$L1<L5<L3 \quad (1);$$

$$L1>L2 \quad (2); \text{ and}$$

$$L1>L4 \quad (3),$$

where L1 represents a width from a center of an image forming area in a longitudinal direction of the electrophotographic photosensitive member to an end of a charging area, L2 represents a width from the center of the image forming area in the longitudinal direction of the electrophotographic photosensitive member to an end of a transferring area, L3 represents a width from the center of the image forming area in the longitudinal direction of the electrophotographic photosensitive member to an end of a surface layer formed area in which the surface layer is formed, L4 represents a width from the center of the image forming area in the longitudinal direction of the electrophotographic photosensitive member to an end of a charge generating layer formed area in which the charge generating layer is formed, and L5 represents a width from the center of the image forming area in the longitudinal direction of the electrophotographic photosensitive member to an end of a cleaning area.

2. An electrophotographic apparatus according to claim 1, wherein the electrophotographic photosensitive member further satisfies Expression (4):

$$L1>L4>L2 \quad (4).$$

3. An electrophotographic apparatus according to claim 1, wherein the electrophotographic photosensitive member further satisfies Expression (5):

$$L1>L2>L4 \quad (5).$$

4. An electrophotographic apparatus according to claim 1, wherein a surface of a charging member to be used in the charging unit and a surface of the electrophotographic photosensitive member have a gap of 200 μm or less secured therebetween.

5. An electrophotographic apparatus according to claim 1, wherein the charging unit is a corona charging device including a grid electrode and being configured to charge a surface of the electrophotographic photosensitive member.

6. An electrophotographic apparatus according to claim 1, wherein the surface layer is a charge transporting layer.

7. An electrophotographic apparatus, comprising:

an electrophotographic photosensitive member having a cylindrical shape;

a charging unit, which is arranged in a non-abutment manner with respect to the electrophotographic photosensitive member, and is configured to charge the electrophotographic photosensitive member;

a developing unit, which is arranged in abutment against the electrophotographic photosensitive member, and is configured to develop a toner image on the electrophotographic photosensitive member; and a transferring unit configured to transfer the toner image onto a transfer material, the electrophotographic photosensitive member comprising a charge generating layer and a surface layer in this order, the electrophotographic photosensitive member satisfying Expression (1), Expression (2), and Expression (3):

$$L1<L5<L3 \quad (1);$$

$$L1>L2 \quad (2); \text{ and}$$

$$L1>L4 \quad (3),$$

where L1 represents a width from a center of an image forming area in a longitudinal direction of the electrophotographic photosensitive member to an end of a charging area, L2 represents a width from the center of the image forming area in the longitudinal direction of the electrophotographic photosensitive member to an end of a transferring area, L3 represents a width from the center of the image forming area in the longitudinal direction of the electrophotographic photosensitive member to an end of a surface layer formed area in which the surface layer is formed, L4 represents a width from the center of the image forming area in the longitudinal direction of the electrophotographic photosensitive member to an end of a charge generating layer formed area in which the charge generating layer is formed, and L5 represents a width from the center of the image forming area in the longitudinal direction of the electrophotographic photosensitive member to an end of a developing area.

8. An electrophotographic apparatus according to claim 7, wherein the electrophotographic photosensitive member further satisfies Expression (4):

$$L1>L4>L2 \quad (4).$$

9. An electrophotographic apparatus according to claim 4, wherein the electrophotographic photosensitive member further satisfies Expression (5):

$$L1>L2>L4 \quad (5).$$

10. A process cartridge, which is configured to be removably mounted to a main body of an electrophotographic apparatus, the process cartridge comprising:

an electrophotographic photosensitive member having a cylindrical shape;

a charging unit, which is arranged in a non-abutment manner with respect to the electrophotographic photosensitive member, and is configured to charge the electrophotographic photosensitive member; and a cleaning unit, which is arranged in abutment against the electrophotographic photosensitive member, and is configured to clean a surface of the electrophotographic photosensitive member, the electrophotographic photosensitive member comprising a charge generating layer and a surface layer in this order, and having a transferring area to be opposed to a transferring unit configured to transfer a toner image onto a transfer material, the electrophotographic photosensitive member satisfying Expression (1), Expression (2), and Expression (3):

$$L1<L5<L3 \quad (1);$$

$$L1>L2 \quad (2); \text{ and}$$

$$L1>L4 \quad (3),$$

where L1 represents a width from a center of an image forming area in a longitudinal direction of the electrophotographic photosensitive member to an end of a charging area, L2 represents a width from the center of the image forming area in the longitudinal direction of the electrophotographic photosensitive member to an end of the transferring area, L3 represents a width from the center of the image forming area in the longitudinal direction of the electrophotographic photosensitive member to an end of a surface layer formed area in which the surface layer is formed, L4 represents a width from the center of the image forming area in the longitudinal direction of the electrophotographic photosensitive member to an end of a charge generating layer formed area in which the charge generating layer is formed, and L5 represents a width from the center of the image forming area in the longitudinal direction of the electrophotographic photosensitive member to an end of a cleaning area.

11. A process cartridge according to claim 10, wherein the charging unit is configured to apply a voltage obtained by superimposing an AC voltage on a DC voltage to a charging member, and form corona discharge between a surface of the charging member and a surface of the electrophotographic photosensitive member, to thereby charge the surface of the electrophotographic photosensitive member.

12. A process cartridge according to claim 10, wherein the charging unit is a corona charging device including a grid electrode and being configured to charge a surface of the electrophotographic photosensitive member.

13. A process cartridge according to claim 10, wherein the surface layer is a charge transporting layer.

14. A process cartridge, which is configured to be removably mounted to a main body of an electrophotographic apparatus, the process cartridge comprising:

an electrophotographic photosensitive member having a cylindrical shape;

a charging unit, which is arranged in a non-abutment manner with respect to the electrophotographic photosensitive member, and is configured to charge the electrophotographic photosensitive member; and a developing unit, which is arranged in abutment against the electrophotographic photosensitive member, and is configured to develop a toner image on the electrophotographic photosensitive member, the electrophotographic photosensitive member comprising a charge generating layer and a surface layer in this order, and having a transferring area to be opposed to a transferring unit configured to transfer the toner image onto a transfer material, the electrophotographic photosensitive member satisfying Expression (1), Expression (2), and Expression (3):

$$L1<L5<L3 \quad (1);$$

$$L1>L2 \quad (2); \text{ and}$$

$$L1>L4 \quad (3),$$

where L1 represents a width from a center of an image forming area in a longitudinal direction of the electrophotographic photosensitive member to an end of a charging area, L2 represents a width from the center of the image forming area in the longitudinal direction of the electrophotographic photosensitive member to an end of the transferring area, L3 represents a width from the center of the image forming area in the longitudinal direction of the electrophotographic photosensitive member to an end of a surface layer formed area in which the surface layer is formed, L4 represents a width from the center of the image forming area in the longitudinal direction of the electrophotographic photosensitive member to an end of a charge generating layer formed area in which the charge generating layer is formed, and L5 represents a width from the center of the image forming area in the longitudinal direction of the electrophotographic photosensitive member to an end of a developing area.

* * * * *